US011889868B2

(12) United States Patent
Kokadir

(10) Patent No.: US 11,889,868 B2
(45) Date of Patent: Feb. 6, 2024

(54) MULTI-SHAPE LOCK AND KEY SYSTEM FOR AN ELECTRONIC CIGARETTE CARTRIDGE AND REFILL BOTTLE THEREIN

(71) Applicant: Sucipto Kokadir, Jarkata Barat (ID)

(72) Inventor: Sucipto Kokadir, Jarkata Barat (ID)

( * ) Notice: Subject to any disclaimer, the term of this patent is extended or adjusted under 35 U.S.C. 154(b) by 153 days.

(21) Appl. No.: 17/278,565

(22) PCT Filed: Dec. 6, 2019

(86) PCT No.: PCT/IB2019/060502

§ 371 (c)(1),
(2) Date: Mar. 22, 2021

(87) PCT Pub. No.: WO2021/044206

PCT Pub. Date: Mar. 11, 2021

(65) Prior Publication Data

US 2022/0354179 A1 Nov. 10, 2022

(30) Foreign Application Priority Data

Sep. 2, 2019 (ID) ..... S00201907660
Sep. 4, 2019 (ID) ..... S00201907767
Oct. 3, 2019 (ID) ..... S00201908739

(51) Int. Cl.

| | |
|---|---|
| ***A24F 40/485*** | (2020.01) |
| ***A24F 40/10*** | (2020.01) |
| ***A24F 40/42*** | (2020.01) |
| ***A24F 15/015*** | (2020.01) |

(52) U.S. Cl.
CPC ..... *A24F 40/485* (2020.01); *A24F 15/015* (2020.01); *A24F 40/10* (2020.01); *A24F 40/42* (2020.01)

(58) Field of Classification Search
CPC ..... A24F 40/485; A24F 15/015; A24F 40/10; A24F 40/42
See application file for complete search history.

(56) References Cited

U.S. PATENT DOCUMENTS

2022/0000180 A1* 1/2022 Rogan ..... A24F 40/10

* cited by examiner

*Primary Examiner* — Travis S Chambers
(74) *Attorney, Agent, or Firm* — Judd M. Patton, Esq.

(57) ABSTRACT

A fluid delivery lock and key system and kit for the refill of an electronic vaping device. The device may utilize a bottle with a pipette head key to one lateral end which may deploy one of a wide number of possible protruding shapes. The lock mechanism may further deploy one of a wide number of matching intruding shapes. The protruding shapes and intruding shapes being engageable with each other for lock and key functionality. The mounting base may be reversibly attached to one end of an electronic cigarette cartridge. The pipette head key may be configured to rotatably engage with the lock mechanism such that a liquid filling hole can be transitioned to an open position and a closed position. The open position permitting fluid delivery into a liquid tank with the closed position preventing fluid escape from the liquid tank.

20 Claims, 14 Drawing Sheets

MULTI-SHAPE LOCK AND KEY SYSTEM FOR AN ELECTRONIC CIGARETTE CARTRIDGE AND REFILL BOTTLE THEREIN

RELATED APPLICATIONS

This application is a U.S. national stage of PCT International Patent Application No. PCT/IB2019/060502, filed Dec. 17, 2019, which claims the benefit of Indonesian patent number S00201908739 filed Oct. 3, 2019; Indonesian patent number S00201907767 filed Sep. 4, 2019, and Indonesian patent number S00201907660 filed Sep. 2, 2019. All of the above-identified applications, the contents of each of which are incorporated by this reference in their entireties for all purposes as if fully set forth herein.

TECHNICAL FIELD

The disclosure herein relates generally to electronic cigarettes. More particularly, the disclosure relates to devices and methods to facilitate a multi-shape lock and key mechanism for use in the refilling of electronic cigarette cartridges from an external reservoir of electronic vaporable liquid.

BACKGROUND

Throughout history people have used and consumed tobacco and tobacco products. This has been encouraged by the tobacco industry through the presentation of advertisements that reflect a lifestyle in which tobacco use and consumption is normalized. Further, marketing coverage by the tobacco industry in addition to the social influence makes a combination strong enough to increase the number of smokers even in the face of seriously fatal diseases. This effect is seen even though consumers of tobacco products understand the effects of tobacco and fully comprehend that nicotine can easily become addictive.

One answer to the endemic problems associated with tobacco consumption is that of the use of electronic cigarettes and the various related products as a replacement to conventional cigarettes and other plant-based tobacco products. Electronic cigarettes use little or no nicotine, can be atomized into vapor, and are less harmful to the users of the electronic cigarette than that of conventional tobacco products. The vapor can be inhaled by smokers the same as is done with a conventional cigarette. A consequence of using electronic cigarettes is that smokers may control the nicotine and thus they aid helping smokers quit smoking entirely by slowly becoming less addicted to nicotine.

The electronic cigarettes currently available on the market usually consist of two major components, a cartridge and a power bank. Commonly, the cartridge is often designed to be disposed after single use. Consumers cannot refill single-use electronic cigarette cartridges with vaporizing liquid once all the liquid has been consumed, the entire device must be disposed. This is unfortunate because although all hardware components are still functioning flawlessly and can be reused, the device is essentially useless without further addition of vaporizing liquid. This kind of design wastes considerable resources and places unnecessary financial burdens on the consumers and users of single-use electronic cigarettes.

Refillable electronic cigarettes are also on the market which helps to abate this issue. However, these multi-use electronic cigarettes tend to be cumbersome to refill which results in spills and wasted vaporizing liquid. Moreover, in areas where the control of vaporizing liquid is controlled by state, governmental, and regulatory bodies, refillable electronic cigarettes represent an area where the black market may take hold by the supply of cheaper and unregulated vaporizing liquid. Such black markets may evade quality control standards, produce dangerous products, and may evade state and local government taxes on these products.

What is needed is a system that permits for the accurate control, accounting, and regulation of electronic vaporizing liquid. Such as system can be verified by local state, governmental, and regulatory bodies as having been properly produced, is safe to use, and has been properly taxed. Further, such a system will greatly diminish the amount of vaporizing liquid that is lost during refill and further ensures that needless waste is not occurring.

SUMMARY

The systems, methods, and devices described herein have innovative aspects, no single one of which is indispensable or solely responsible for their desirable attributes. Further, certain deficiencies of the prior art are overcome by the provision of embodiments of an apparatus, kit, and system in accordance with this present disclosure. Without limiting the scope of the claims, some of the advantageous features will now be summarized.

The disclosure herein may relate to a multi-shape key system and locking mechanism of a cartridge and an electronic cigarette device. Such a particular device may be made up of a casing and an atomization chamber. The atomization chamber may be enclosed within the casing and a vapor opening may be located on the top of the casing. The tank for liquid storage may be formed by a bottom of the atomization chamber and an inner wall of the casing. The lower section of the atomization chamber may be set on a mounting base which may have a clipping mechanism that clips onto the casing. One end of the mounting base may have a liquid filling hole. The bottom of the atomization chamber may be designed with a first stage liquid inflow hole. The liquid filling hole on the mounting base and the first stage liquid inflow hole is lined correspondingly to form a cavity, and within the cavity, it is accommodated with a turning lock mechanism that is enclosed with a ceiling on the top end, on the inner side of the lock, it has a liquid flowing passageway, the passageway may be cut through the ceiling to form a second stage liquid inflow hole. By turning the lock mechanism, consumers may self-refill the electric cigarette with liquids. The first key jamming position and the second key jamming position may be adjusted for the opening or closing of the passageway by turning the lock with a particularly shaped pipetted bottles or ampoules, thus making the liquid refilling process more convenient and more efficient.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are not to be considered limiting of its scope, the disclosure will be described with additional specificity and detail through the use of accompanying drawings. Accordingly, further advantages of the present invention may become apparent to those skilled in the art with the benefit of the following detailed description of the various embodiments and upon reference to the accompanying drawings in which:

DETAILED DESCRIPTION

Figure 1:
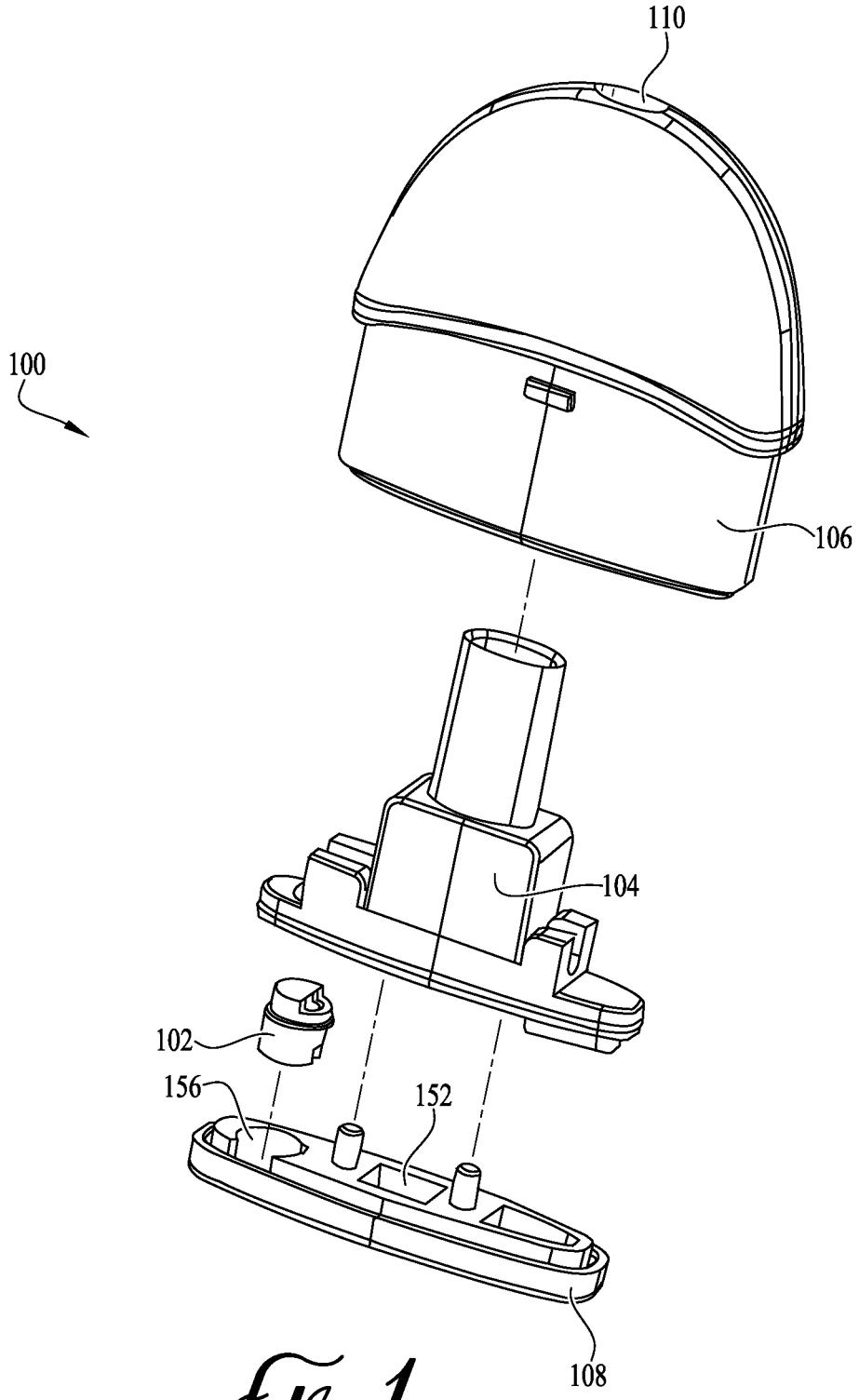
FIG. 1 is a diagrammatic exploded perspective view of an apparatus (device) in accordance with one non-limiting embodiment of an electronic cigarette refillable cartridge for the use with nicotine and non-nicotine vaporizing technology.

Embodiments of systems, components, and methods of assembly and manufacture will now be described with reference to the accompanying figures. Although several embodiments, examples, and illustrations are disclosed below, it will be understood by those of ordinary skill in the art that the embodiments described herein extend beyond the specifically disclosed configurations, examples, and illustrations, and can include other uses of the disclosure and obvious modifications and equivalents thereof. The terminology used in the descriptions presented herein is not intended to be interpreted in any limited or restrictive manner simply because it is being used in conjunction with a detailed description of certain specific embodiments of the disclosure. In addition, embodiments of the disclosure can comprise several novel features and no single feature is solely responsible for its desirable attributes or is essential to practicing any one of the several embodiments herein described.

Certain terminology may be used in the following description for the purpose of reference only, and thus are not intended to be limiting. For example, terms such as "above," "below," "lower," or "upper" refer to directions in the drawings to which reference is made. Terms such as "front," "back," "left," "right," "rear," "top," "bottom," "side," and so forth describe the orientation and/or location of portions of the components or elements within a consistent but arbitrary frame of reference which is made clear by reference to the text and the associated drawings describing the components or elements under discussion.

Moreover, terms such as "first," "second," "third," and so on, may be used to describe separate components. Such terminology may include the words specially mentioned above, derivatives thereof, and words of similar import. Additionally, if directional references such as up, down, left, right, front, back, above, below, upper, lower, etc., were used in reference to the various figures, the directional indications of their relative positioning, and any dynamic movement is only limited to orientation of that particular drawing under consideration. If the original reference placement is changed, then the indication of directions should be changed accordingly. Furthermore, if terms such as first or second were used, they are solely used for the purpose of describing the logical manner for the implementation of the invention, it cannot be interpreted implicitly or explicitly as the relative importance or the number of unique features among the subjects discussed. When multiple unique features exist, it can be implicitly or explicitly indicated that there is at least one unique feature.

This disclosure may relate to the development of a unique cartridge 100 that has lock mechanism 102. The cartridge 100 may utilize a lock mechanism 102 and may be a component of commonly used electronic cigarette devices (not shown). Accordingly, the internal structure of the cartridge 100 may be designed such that it may store a predetermined volume of electronic cigarette liquid (hereinafter e-liquid). As a consumer uses the cartridge 100 of an electronic cigarette (not shown), the e-liquid may be atomized by an atomization chamber 104 thereby producing vapor (not shown) which may be inhaled by the user of the cartridge 100.

Figure 2:
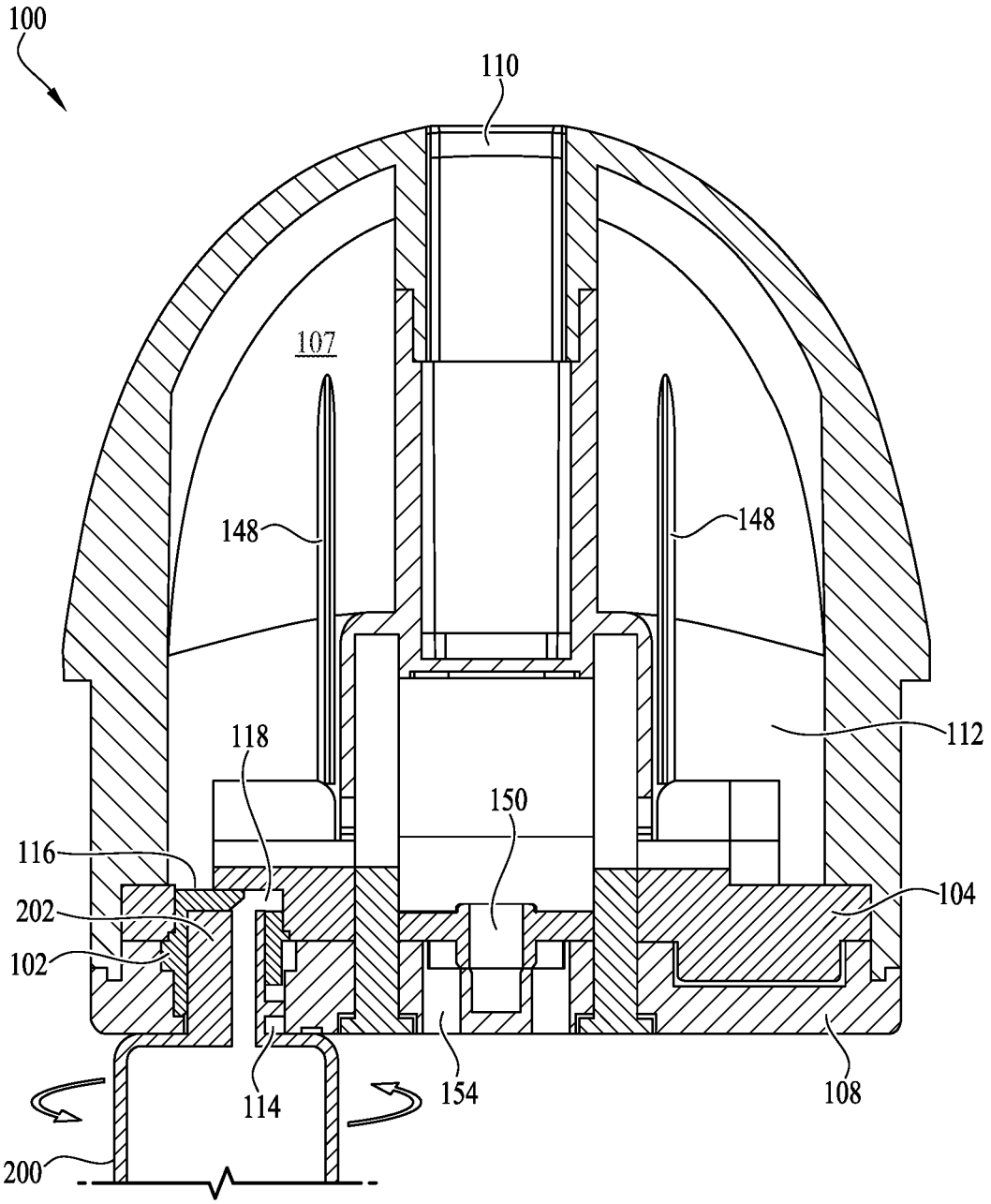
FIG. 2 is a cross-sectional view of one non-limiting embodiment of an electronic cigarette refillable cartridge for use in facilitating the creation of vapor from nicotine or non-nicotine containing liquid medium, wherein a refill bottle is illustrated as engaged with the cartridge and is in a closed configuration.

Referring now to FIGS. 1 through 8, the lock mechanism 102 may be equipped between the atomization chamber 104 and a mounting base 108, or either onto the atomization chamber 104 or the mounting base 108, respectively. The cartridge 100 may be comprised of a casing 106 and atomization chamber 104. The casing 106 may further have a vapor opening 110 which may permit the outflow of atomized or vaporized, e-liquid medium. The atomization chamber 104 may be enclosed in a casing 106 and the vapor opening 110 may be located to the top of the casing 106. One advantageous feature of this disclosed embodiment is that the bottom of atomization chamber 104 and the inner wall of casing 106 may form the liquid tank 112 as shown in FIG. 2. As noted, the lower part of atomization chamber 104 may be attach to the mounting base 108 by way of a clip, a spring, friction, a protrusion, or other commonly used mechanical methods of attaching and securing two distinct bodies.

Figure 3:
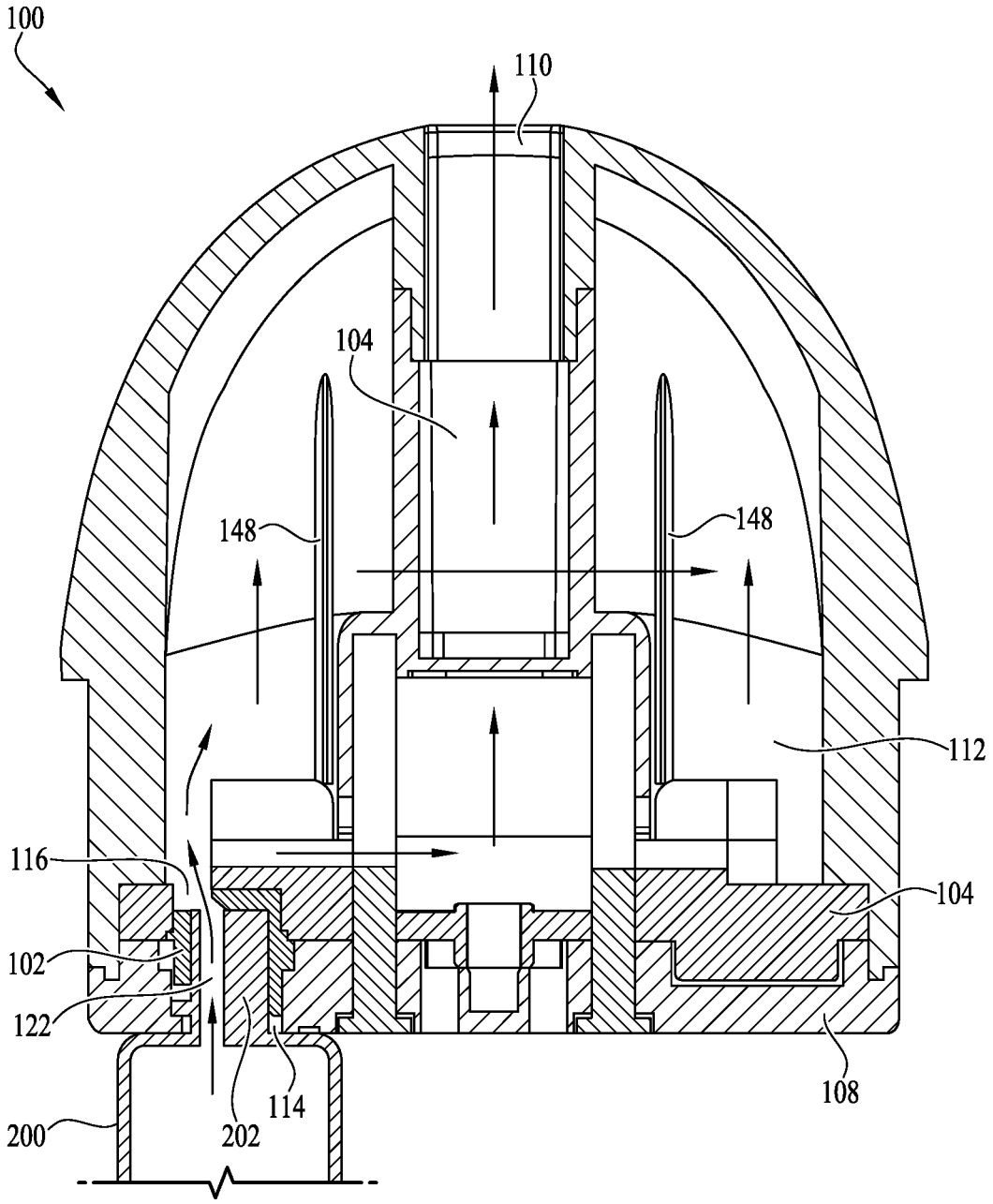
FIG. 3 is a is a cross-sectional view of one non-limiting embodiment of an electronic cigarette refillable cartridge for use in facilitating the creation of vapor from a nicotine or non-nicotine liquid medium, wherein the direction of airflow through the device is indicated, and in which further illustrates a refill bottle as engaged with the cartridge and is in an open configuration.
Figure 7:
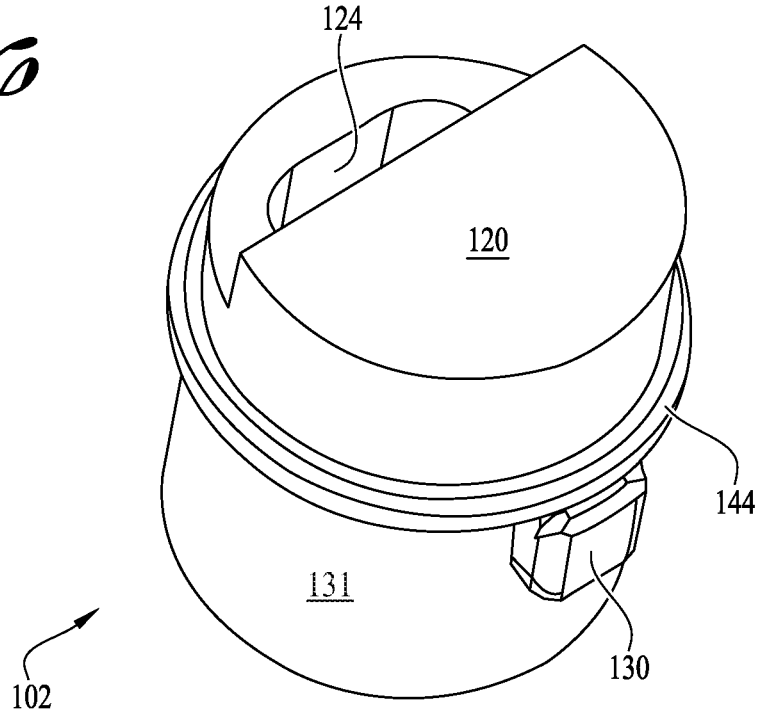
FIG. 7 is a further perspective view of one non-limiting embodiment of a lock mechanism for use with an apparatus (device) for facilitating the creation of vapor from nicotine or non-nicotine liquid medium.
Figure 8:
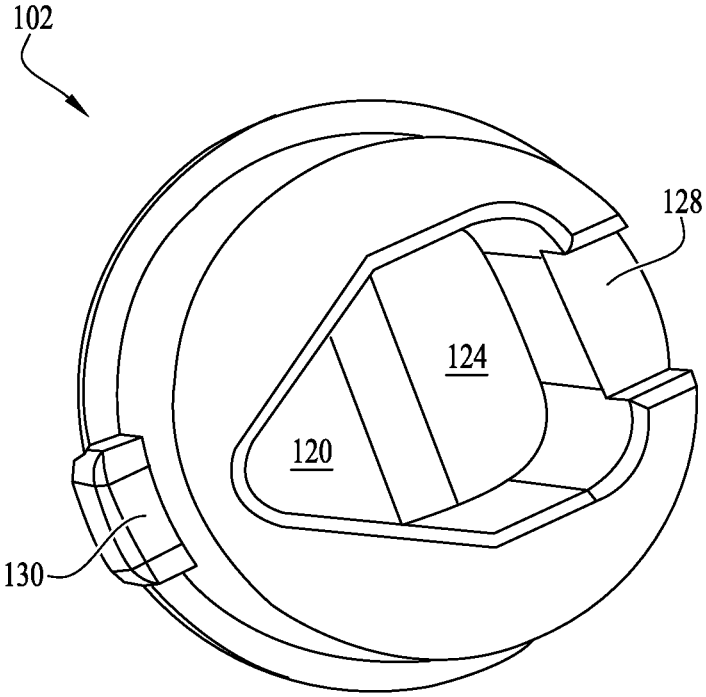
FIG. 8 is a further perspective view of one non-limiting embodiment of a lock mechanism for use with an apparatus (device) for facilitating the creation of vapor from nicotine or non-nicotine liquid medium wherein the lower portion of the lock mechanism is illustrated.
Figure 9:
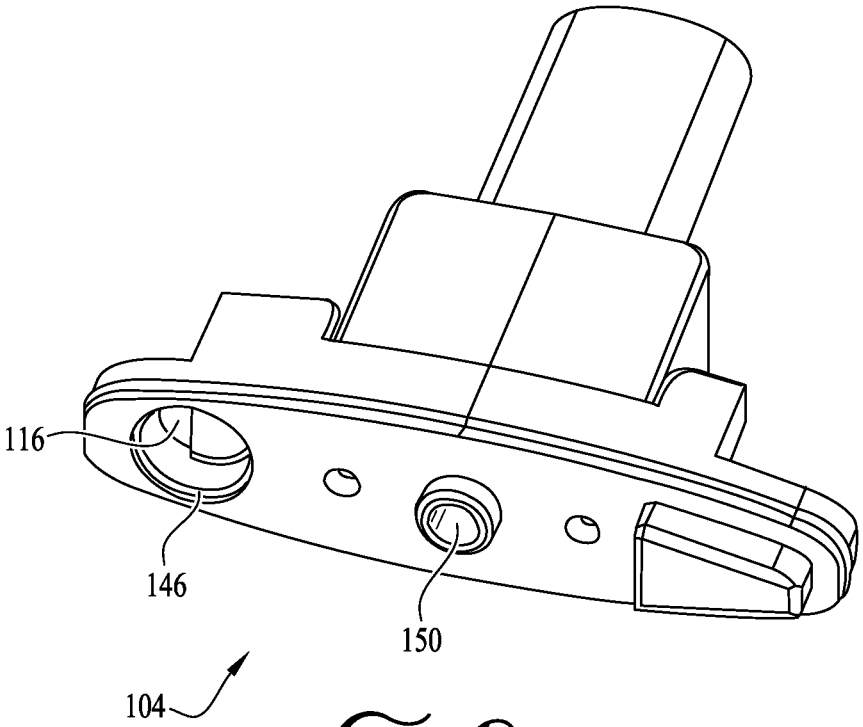
FIG. 9 is a perspective view of one non-limiting embodiment of an atomization chamber for use with an apparatus (device) for facilitating the creation of vapor from nicotine or non-nicotine liquid medium.
Figure 17:
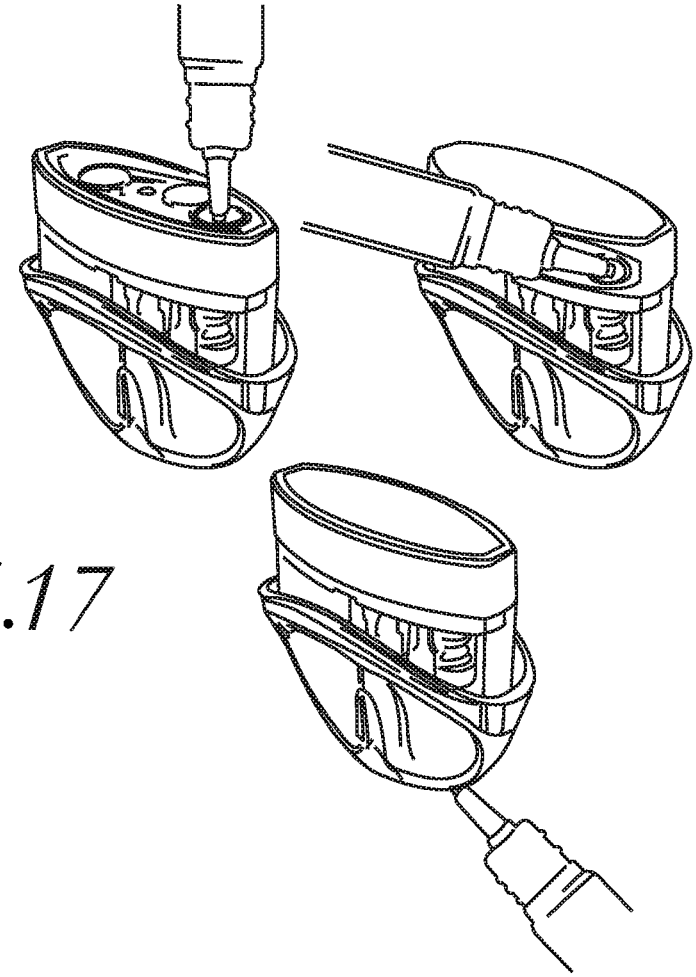
FIG. 17 is a perspective view of several non-limiting embodiments illustrating potential refill locations of an apparatus (device) for facilitating the creation of vapor from nicotine and non-nicotine liquid medium.

There may be a liquid filling hole 114 for use in refilling the liquid tank 112, located on one end of the mounting base 108 as mentioned above and shown in FIG. 2. Notably, while the liquid filing hole 114 may be located to one end of the mounting base, the liquid filling hole 114 is contemplated to exist at other locations and does not need to be exclusively defined by passage through the mounting base, as the full lock mechanism 102 may be placed at any location on the cartridge 100, thus the liquid filling hold 114 could likewise be located to any end of the cartridge 100 as is illustrated in FIG. 17. Further, there may be a first stage liquid inflow hole 116 located to the bottom of the atomization chamber 104. The liquid filling hole 114 on the mounting base 108 and the first stage liquid inflow hole 116 may be aligned in a corresponding fashion to form a cavity 118. The cavity 118 may be accommodated with the lock mechanism 102 as shown in FIGS. 2 and 3. The lock mechanism 102 may include a ceiling 120 located on the top end as shown in FIG. 7. The ceiling 120 may comprise an inner and upper side of the lock mechanism 102 when viewed from below as indicated in FIG. 8. The lock mechanism 102 may further comprise a liquid inflow passageway 122, the liquid inflow passageway 122 may cut through the ceiling 120 to form a second stage liquid inflow hole 124 as illustrated in FIG. 8. The lock mechanism 102 may be operational by turning or twisting and will be discussed in greater detail elsewhere in the application.

Specifically illustrated in FIGS. 2 and 3 is the engagement of a bottle 200 with a pipette head key 202 inserted into the lock mechanism 102. The lock mechanism 102 is shown in a closed configuration and may be subsequently rotated. Shown well in FIG. 2 is that after the pipette head key 202 is inserted into the lock mechanism 102, the bottle 200 may be rotated, which may then result in simultaneous rotation of the lock mechanism 102 and may cause the lock mechanism to transition from a closed configuration as shown in FIG. 2 to an open configuration as shown in FIG. 3. Accordingly, the open configuration of the lock mechanism 102 may permit the inflow of e-liquid from the bottle 200 into a liquid tank 112.

Still referring to FIGS. 1 through 7, the present disclosure of the lock mechanism 102 for use with the cartridge 100 may be comprised partly from the casing 106 and the atomization chamber 104 components. Previously noted and illustration FIG. 2 is that the vapor opening 110 which may be located to the upper end of the casing 106. As e-liquid is atomized in the atomization chamber 104, the vapor may be inhaled by a consumer through the noted vapor opening 110 with the vapor following a path as illustrated in FIG. 3. In some embodiments, the bottom of the atomization chamber 104 and the inner wall of the casing 106 may form the electronic cigarette liquid tank 112. The mounting base 118 may be located to the lower portion of the atomization chamber 104, and, by way of example, may be clipped, friction fit, snapped, elastically retained, or generally mechanically connected to the casing 106.

As noted, the liquid refilling hole 114 may be located to one end of the mounting base 108, and similarly there may be a first stage liquid inflow hole 116 located to the lower portion of the atomization chamber 104 as illustrated in FIG. 2. The first liquid inflow hole 116 and the liquid filling hole 114 may be aligned correspondingly to form the cavity 118 as illustrated in FIG. 3. The cavity 118 may be equipped with a lock mechanism 102 which may rotate along one predetermined axis as illustrated in FIGS. 2 and 3. The lock mechanism may have a liquid inflow passageway 122 going through the middle portion as illustrated in FIG. 3. As the lock mechanism 102 is rotated to an open configuration, the liquid inflow passageway 122 may line up with the liquid filling hole 114, the second stage liquid inflow hole 124, and the first stage liquid inflow hole 116 thereby creating a filling path as illustrated in FIG. 3.

As a consumer refills the e-liquid via the liquid filling hole 114, the liquid may flow through the lock mechanism 102 via the liquid inflow passageway 122 and may reach the second stage liquid inflow hole 124 as illustrated in FIG. 8. From the second stage liquid inflow hole 124 the e-liquid may flow to the first stage liquid inflow hole 116, and finally, from first stage liquid inflow 116, the liquid enters the tank 112, completing the refilling process (as shown in FIGS. 3 and 8). Please recall that the lock mechanism 102 may rotate along one predetermined axis inside the cavity 118, and that the lock mechanism 102 may be enclosed with a ceiling 120 on one end. Due to the aforementioned configuration, when the consumer finishes the refilling process, the lock mechanism 102 can be rotated counter to the prior rotation and to a closed configuration by rotation of the bottle 200 and pipette head key (as illustrated in FIG. 3) on the liquid filling hole 114 and lock mechanism 102. By doing so, the lock mechanism 102 may be rotated to a position wherein a ceiling 120 may be covering the first stage liquid inflow hole 116 as shown in FIG. 2. Accordingly, the area of the ceiling 120 may be larger than the opening located at the first stage liquid inflow hole 116 and hence the ceiling 120 may completely close up the first stage liquid inflow hole 116. This may result in liquid not having the opportunity to leak from liquid tank 112.

Figure 4:
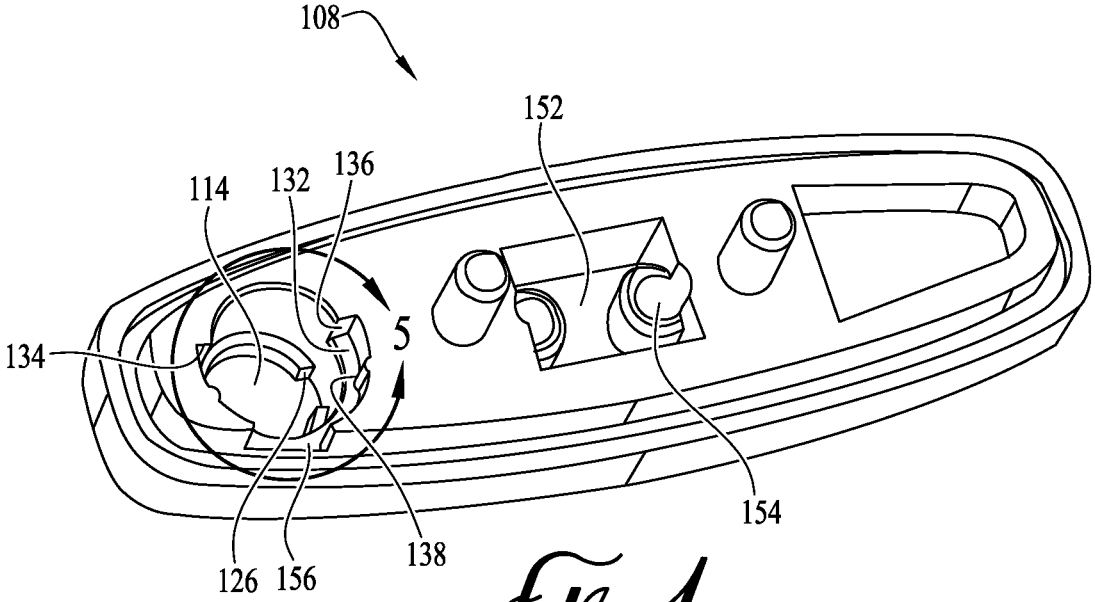
FIG. 4 is a perspective view of one non-limiting embodiment of a mounting base for use with an apparatus (device) for facilitating the creation of vapor from nicotine or non-nicotine liquid medium.
Figure 5:
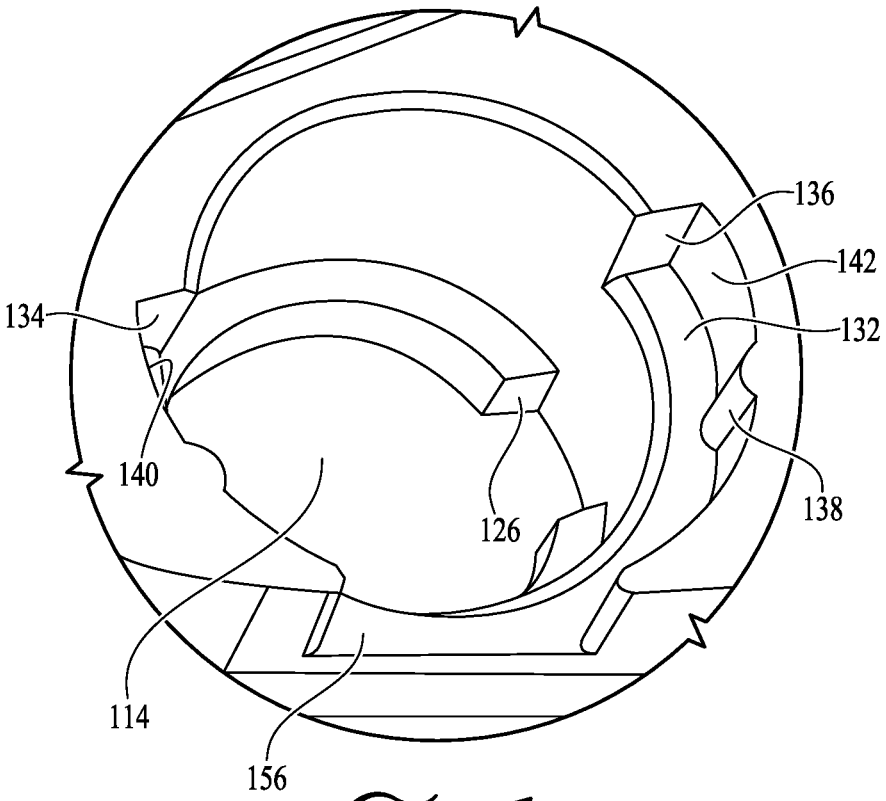
FIG. 5 is a perspective isolated view from FIG. 4 of one non-limiting embodiment of a liquid filling hole for use with an apparatus (device) for facilitating the creation of vapor from nicotine or non-nicotine liquid medium.
Figure 6:
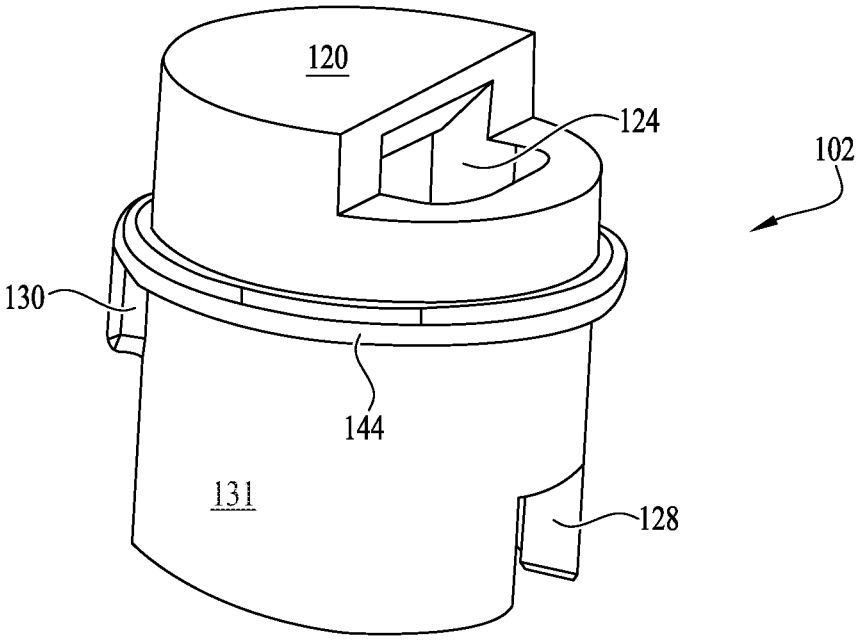
FIG. 6 is a perspective isolated view of one non-limiting embodiment of a lock mechanism for use with an apparatus (device) for facilitating the creation of vapor from nicotine or non-nicotine liquid medium.

Referring now to FIGS. 4 through 8, the bottom of the liquid refilling hole 114 may hold an entrapment ledge 126. The bottom of the lock mechanism 102 may hold an entrapment notch 128 as shown in FIG. 6. The use of the entrapment ledge 126 and the entrapment notch 128 may result in an improvement to the operation of the rotational action along an axis of the lock mechanism 102 when the appropriate refill bottle 200 is used with the appropriate pipette head key 202. Accordingly, the pipette head key 202 of the refill bottle 200 may employ a wide variety and type of shapes which may be identical to that of the liquid filling hole 114. The approximately identical shape may result in easily rotating the lock mechanism 102 by insertion of the pipette head key 202 with an approximately identical shape as the liquid filling hole 114. For the particular prototype implemented for this disclosure, the shapes of the liquid filling hole 114 are illustrated in FIGS. 8, 14, 18, 19, and 20; however, the pipette head key 202 and the liquid filling hole 114 of the lock mechanism 102 may be designed to have a wide variety of shapes, by way of example, a gear shape, a star shape, an oval shape, a rhomboid shape, a rectangular shape, any asymmetrical shape, any symmetrical shape, or any other shape which may conceivably function for the intended application. The lock mechanism 102 and the pipette head key 202 may be considered as a combination, as a lock, and a key respectively.

Figure 14:
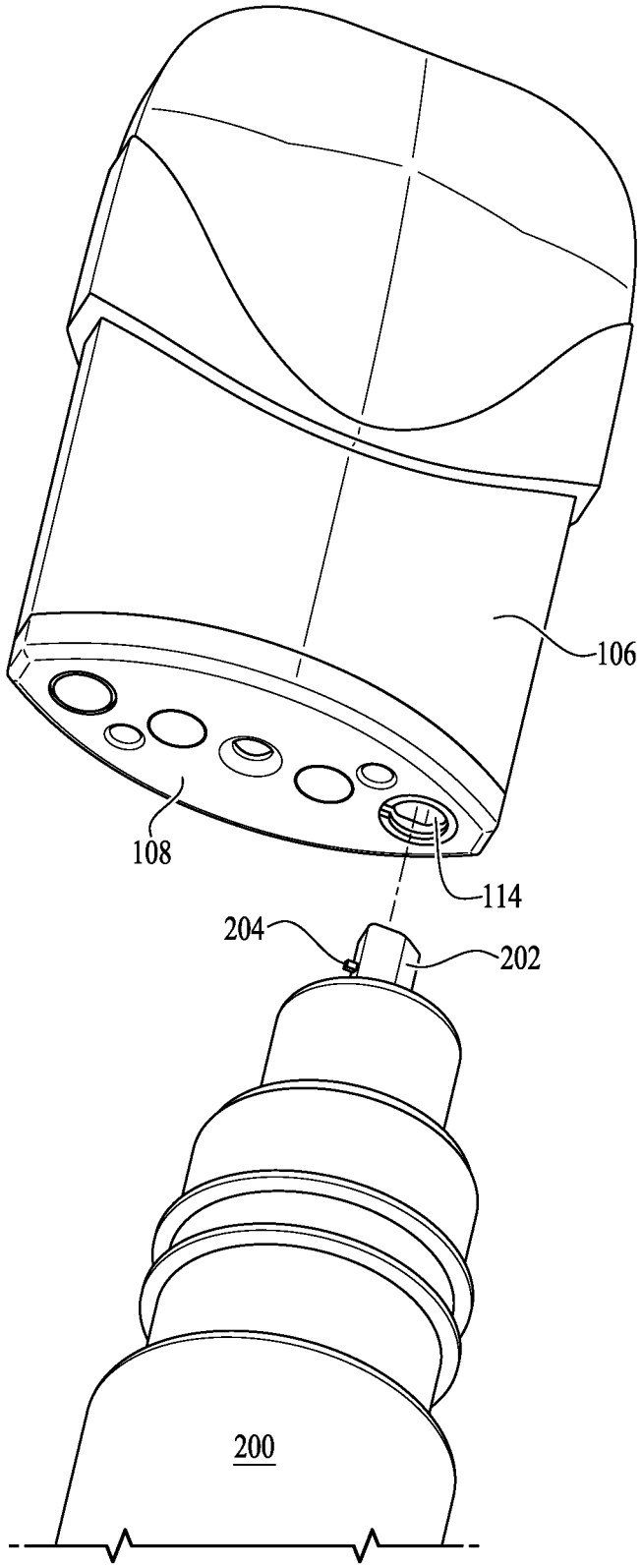
FIG. 14 is a perspective diagrammatic view of one non-limiting embodiment of one potential engagement path of a refill bottle for use with an apparatus (device) for facilitating the creation of vapor from nicotine and non-nicotine liquid medium.
Figure 15:
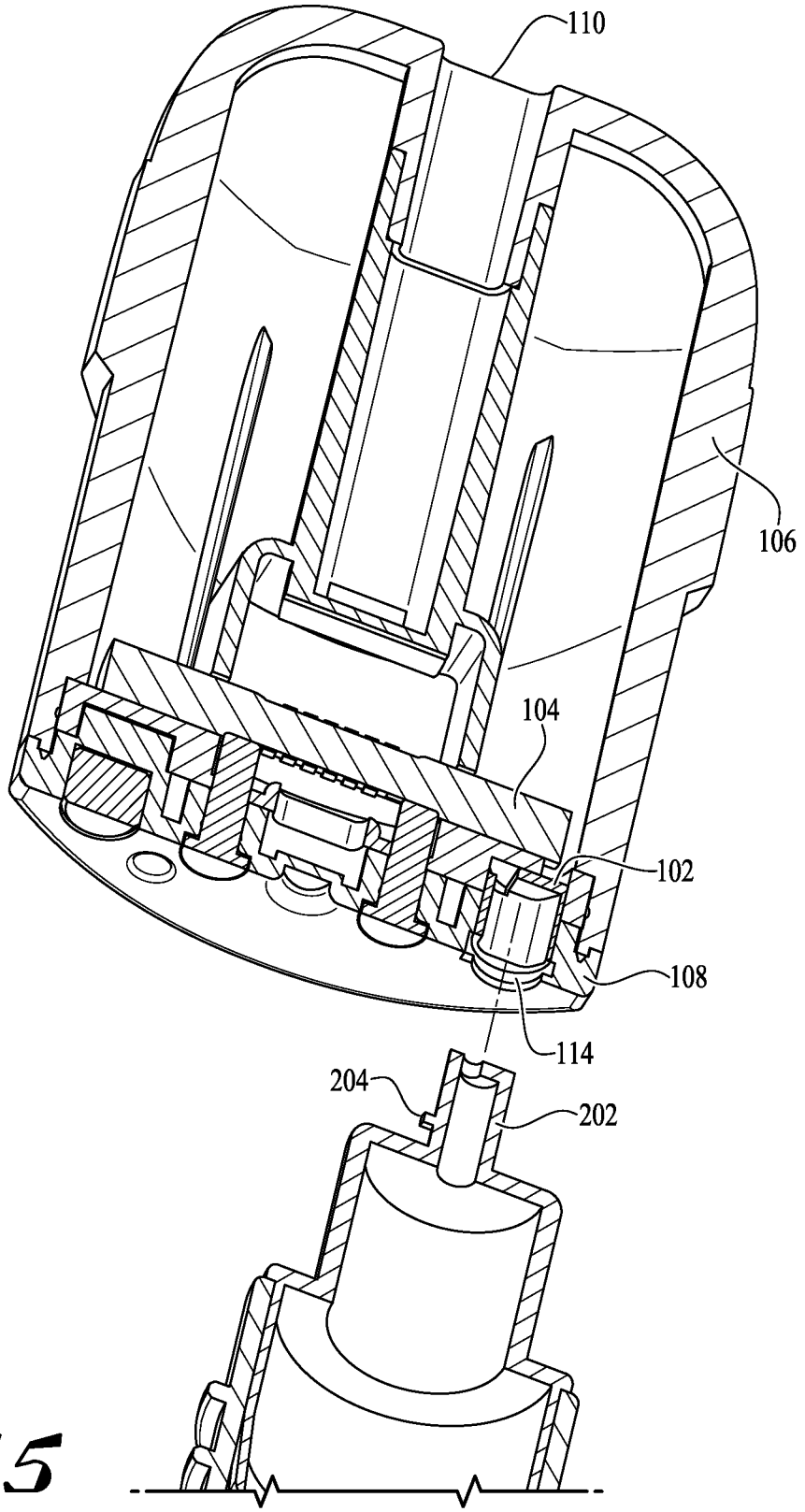
FIG. 15 is a cross-sectional perspective view of one non-limiting embodiment of one potential engagement path for a refill bottle for use with an apparatus (device) for facilitating the creation of vapor from nicotine and non-nicotine liquid medium.
Figure 20:
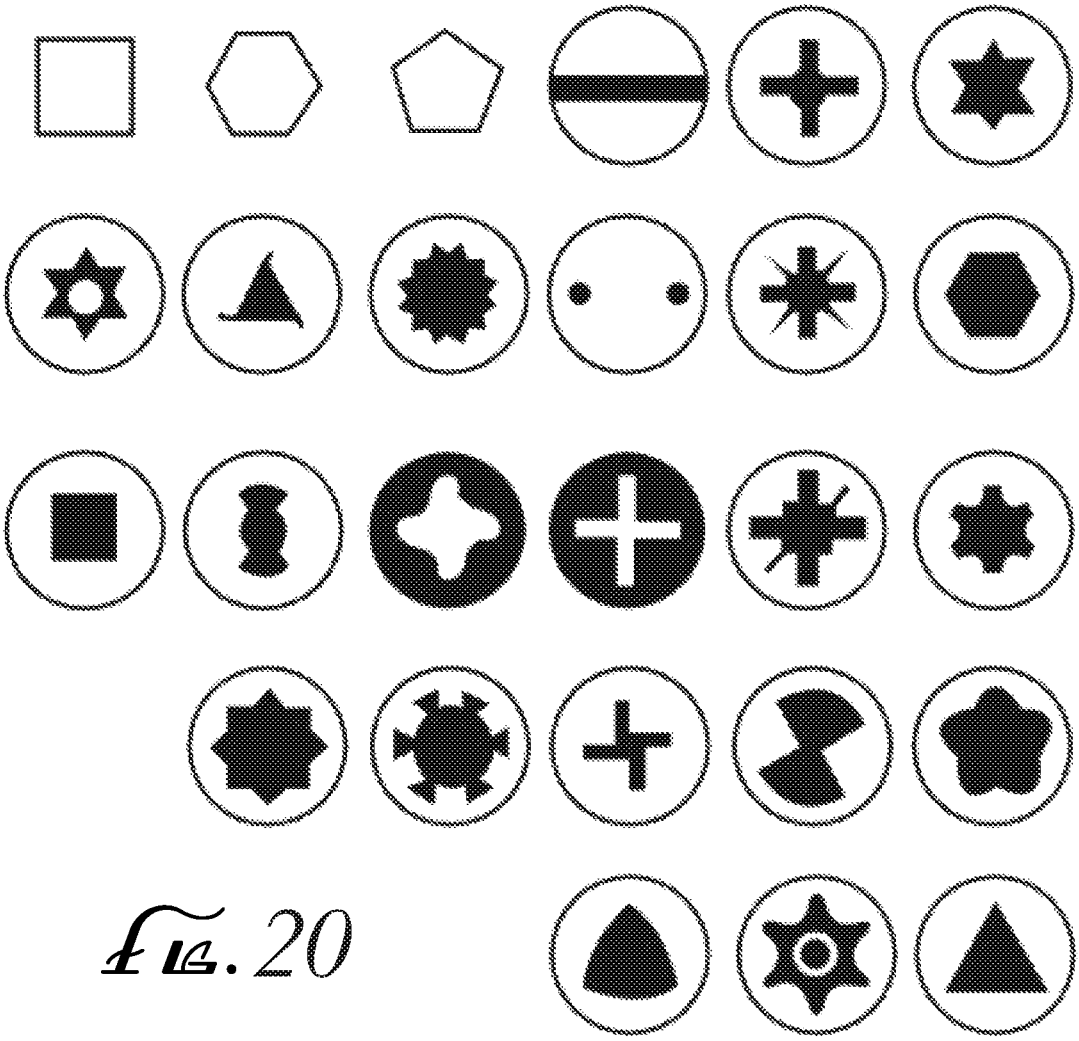

Notably, referring now to FIG. 20, these shapes may appear to be two dimensional when viewed from a vantage which is directly above or below the shape or when a cross-sectional area is cut from the same vantage (as illustrated in FIG. 20). The pipette head key 202 may be further considered to be a protruding shape, while the liquid filling hole 114 of the lock mechanism 102 may be considered to be an intruding shape. The three dimensionality of the shape may occur when the cross-sectional area is projected along a three-dimensional axis when viewed from a lateral perspective angle (as seen in FIG. 14). In other words, if the shape is viewed along a standard three dimensional x, y, z, coordinate grid, along two of the coordinates the shape may appear like the shape illustrated in FIG. 20, then when viewed along the third axis, the shape will appear to be an extruded version of the two dimensional shapes along the third coordinate. In still other terms, if the shape is plotted out initially on a two-dimensional plane, the shape would then appear to be bossed or protruded out of the initially two-dimensional plane to create the three-dimensional pipette head key 202. It is this shape, associated with the pipette head key 202 which may inserted into the lock mechanism 102. The entrapment protrusion 204 may then mate with the entrapment notch 128 after a rotational configuration which may result in entrapment of the pipette head key 202 internal to the lock mechanism 102 as shown in FIGS. 2 and 3.

Accordingly, any of the aforementioned shapes (non-limiting examples illustrated in FIG. 20) functioning for the entrapment ledge 126 and entrapment notch 128, may be inserted via the liquid refill hole 114 and into the lock mechanism 102. The pipette head key 202 may be inserted up to the entrapment ledge 126 and the entrapment notch 128, wherein the lock mechanism 102 may then be rotated by rotating the refill bottle 200 as shown between FIGS. 2 and 3. This may cause the entrapment ledge 126 and entrapment notch 128 to become misaligned from the perspective of a straight line. Hence the entrapment protrusion 204 of the pipette head key 202 may be inserted at the entrapment notch 128, rotated, and the refill bottle 200 would not fall off from and would be locked onto, the lock mechanism of the cartridge 100 due to the entrapment protrusion becoming entrapped. As the bottle 200 is rotated around a predetermined axis of rotation, the entrapment protrusion 204 rotates the lock mechanism 102. As the rotation proceeds, the entrapment protrusion 204 may slide above the entrapment ledge 126, the entrapment ledge 126 may not have free rotation due to being a member bound to the mounting base 108. Because the lock mechanism 102 may freely rotate and the entrapment ledge 126 may not, the entrapment protrusion 204 is therefore held between the entrapment ledge 126 and the upper portion of the entrapment notch 128 of the lock mechanism 102. The bottle 200, and the pipette head key 202 may only be removed when the entrapment ledge 126 and entrapment notch 128 are aligned with respect to a straight sightline, this may be achieved by rotating the bottle 200 in an opposite direction from which the locking rotation occurred. This effectively prevents the bottle 200 from falling out accidentally and results in a refilling process which is more convenient.

Referring now to FIGS. 7 to 11, on the outer wall of the locking mechanism 102, there may be a first rotation limitation marker 130. The top of the liquid refilling hole 114 may further have a first indented cut out 132, and the first rotation limitation marker 130 may be free to rotate within the first indented cut out 132 mentioned above. The first indented cut out 132 may have a first positioning point 134 and a second positioning point 136 (shown in FIG. 5). The top of the liquid refilling hole 114 may have multiple position limitation poles 138. The position limitation pole 138 may lay within the first indented cut out 132 and the first positioning point 134, forming the first jamming slot 140 as illustrated in FIG. 5. The position limitation pole 138 and the second positioning point 136 forms the second jamming slot 142.

Figure 10:
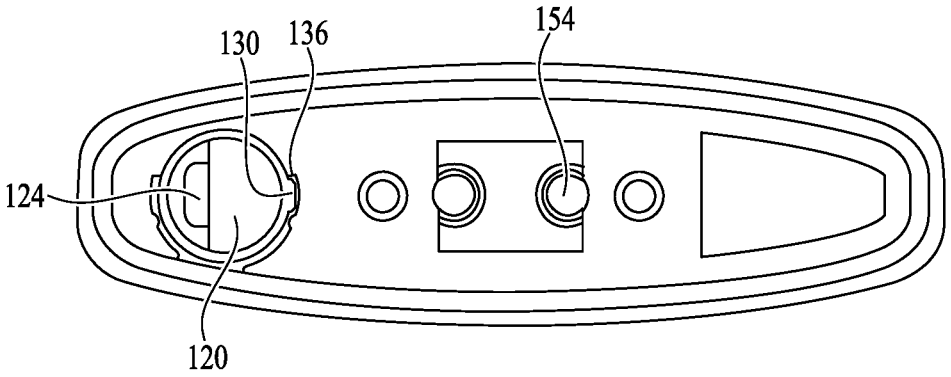
FIG. 10 is a plan view of one non-limiting embodiment of a mounting base with an installed lock mechanism for use with an apparatus (device) for facilitating the creation of vapor from a nicotine or non-nicotine liquid medium, wherein the lower portion of the mounting base is illustrated and a liquid intake passageway is in an open configuration.
Figure 11:
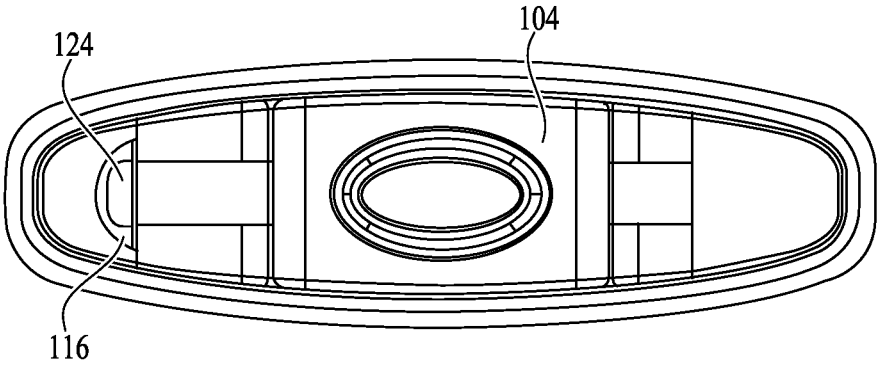
FIG. 11 is a plan view of one non-limiting embodiment of an atomization chamber attached to a mounting base for use with an apparatus (device) for facilitating the creation of vapor from nicotine or non-nicotine liquid medium, wherein the liquid intake passageway is in an open configuration.
Figure 12:
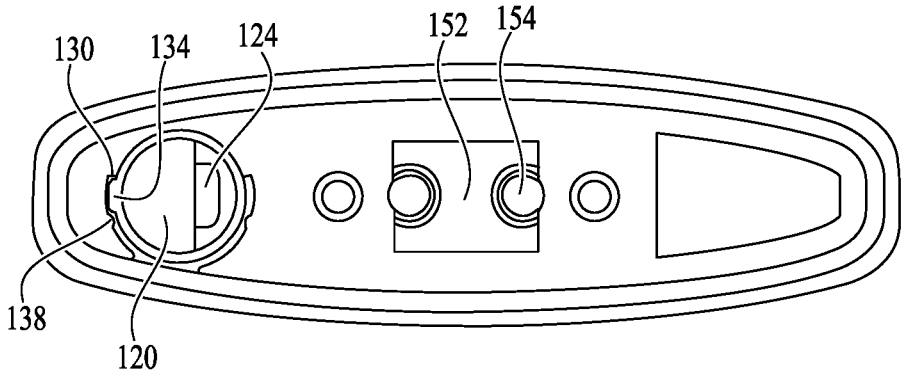
FIG. 12 is a plan view of one non-limiting embodiment of a mounting base with installed lock mechanism for use with an apparatus (device) for facilitating the creation of vapor from nicotine or non-nicotine liquid medium, wherein the lower portion of the mounting base is illustrated and a liquid intake passageway is in a closed configuration.
Figure 13:
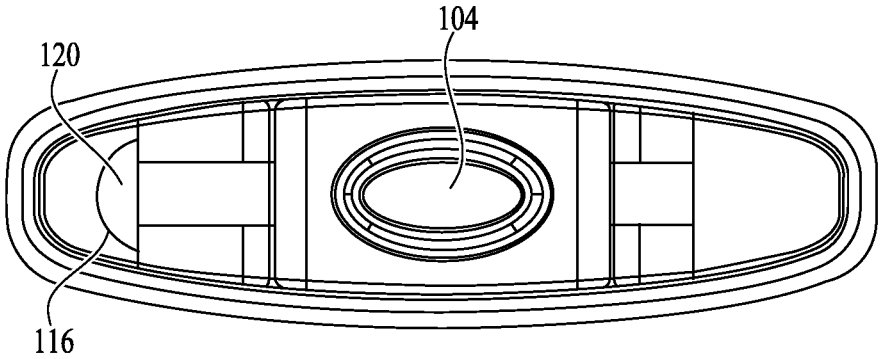
FIG. 13 is a plan view of one non-limiting embodiment of an atomization chamber attached to a mounting base for use with an apparatus (device) for facilitating the creation of vapor from nicotine or non-nicotine liquid medium, wherein the liquid intake passageway is in a closed configuration.

Referring to FIGS. 5 through 13, on the outer wall of the locking mechanism 102, there may be a first rotation limitation marker 130, the top of the liquid refilling hole 114 may also have a first indented cut out 132 as shown in FIGS. 4 and 5. Since the lock mechanism 102 may be rotated freely, the first rotation limitation marker 130 may also be free to rotate within the first indented cut out 132 mentioned above, consequently achieving the closed and open configurations of the lock mechanism 102. The first indented cut out 132 may further have a first positioning point 134 and a second positioning point 136 as seen in FIG. 5. When the first rotation limitation marker 130 touches the first positioning point 134, the first rotation limitation marker 130 may be positioned within the first jamming slot 140, and the ceiling 120 may lay on the same side as the first rotation limitation marker 130. At this position the ceiling 120 may cover the first liquid inflow hole 116 and may shut the tank 112 as illustrated in FIGS. 12 and 13. When the first rotation limitation marker 130 rotates and touches the second positioning point 136, the first rotation limitation marker 130 may be positioned within the second jamming slot 142. The second liquid inflow hole 124 may lay on the opposite side of the first rotation limitation marker 130. In this position, the second liquid inflow hole 124 may line up with the first liquid inflow hole 116 so that refilling process can be carried out as illustrated in FIGS. 10 and 11. On the top of the liquid refilling hole 114, there may be multiple position limitation poles 138. The position limitation poles 138 may similarly operate in conjunction with the first positioning point 134 and a second positioning point 136, respectively. The position limitation poles 138 and the first positioning point 134 may form the first jamming slot 140. The first rotation limitation marker 130 and the second positioning point 136 may further form the second jamming slot 142. When the first rotation limitation marker 130 touches either the first positioning point 134 or the second positioning point 136, additional external force could make the lock mechanism 102 unintentionally rotate beyond a maximum tolerance. This may be very inconvenient while refilling. This could further cause leaking problem while the lock mechanism 102 is in the locked configuration. Hence while the first rotation limitation marker 130 is jammed at the first jamming slot 140 or second jamming slot 142, more effort may be required from the end-user to rotate the lock mechanism 102, which may result in the lock mechanism 102 maintaining an opened configuration or closed configuration with more overall stability.

Furthermore, on the outer wall of the lock mechanism 102, there may be a second rotation limitation marker 144, a second indented cut out 146 on the bottom of the atomization chamber 104, and a second rotation limitation marker 144 which may be slotted into the second indented cut out 146. Particularly, there may be a ring shape second rotation limitation marker 144 on the outer wall of the lock mechanism 102, and correspondingly, there may be a second indented cut out 146. The second rotation limitation marker 144 may be jammed with the second indented cut out 146. Since the ceiling 120 of lock mechanism 102 may be in contact with the bottom of atomization chamber 104, the mounting base 118 may be clipped on the lower part of the atomization chamber 104. While an end-user is operating the rotational aspect of the lock mechanism 102, excessive force could easily make the atomization chamber 104 fall off from the mounting base, thus causing damage to the internal structure of the cartridge 100. With the implementation of the second rotation limitation marker 144, excessive force may be transferred to the second rotation limitation marker 144, and consequently may reduce the possibility of damaging the components of the cartridge 100 while consumer is operating the lock mechanism 102.

As illustrated in FIGS. 2 and 3, the inner wall of the casing 106 may be lined with guide rails 148. The guide rails 148 may aid the bottom of the atomization chamber 104 slide within the guide rails 148 thereby properly aligning the components. Further, the guide rails 148 on the inner wall of the casing 106 may aid in alignment while assembling the cartridge 100 and likewise, as the atomization chamber is slid from the top of the guide rails 148 to the bottom of the guide rails 148. Moreover, when the cartridge 100 assembly is completed, the atomization chamber 104 being properly aligned with guide rails 148 may avoid the atomization chamber 104 from moving freely and fall out during the usage of the cartridge 100. The guide rails 148 may securely hold the bottom of the atomization chamber 104, which would prolong the life expectancy of the atomization chamber 104 and the cartridge 100 overall.

As illustrated in FIGS. 9 through 13, there may be a first air intake hole 150 positioned at the center of the bottom of the atomization chamber 104, and there may be an indented slot 152 located at the center of the mounting base 118, along with a second air intake hole 154 which may be positioned within the indented slot 152. The first air intake hole 150 and second air intake hole 154 may be inter-operable and/or independently adjustable. Both of the first air intake hole 150 positioned at the center of the bottom of the atomization chamber 104, and the second air intake hole 154 positioned within the indented slot 152 may be used for air intake, but since it is uncommon for liquid to leak out from the tank 112 via the first air intake hole 150, and may inherently flow into the indented slot 152, the liquid would not come into contact with the second air intake hole 154, since there is a difference in position this may aid in preventing liquid leakage. When the second air intake hole 154 and the first air intake hole 150 are linked, the liquid may flow to the second air intake hole 154 via the first air intake hole 150, and then may leak to external areas of the liquid tank 112 via the second air intake hole 154. This may result in negative experiences for consumers.

Moreover, the first indented cut out 132 mentioned above may have a dedicated opening 156. An operator may observe the rotating status of the lock mechanism 102 through this opening 156 and react when there is a fault that may cause the lock mechanism 102 to fail to rotate freely. Similar failures can also be easily observed from the opening 156 making it easier for fault detection and maintenance.

In particular, the bottom of the lock mechanism 102 may be above the bottom of the liquid refilling hole 114. This is so designed because when the cartridge 100 is not filled with liquid, the lock mechanism 102 may be exposed to the open environment. Thus, if the cartridge 100 is not used over a period of time, dust may enter the liquid tank 112 or be pushed in during a later e-liquid refill which would impact the normal operation of the electronic cigarette (not shown). Also with the difference in height, a sealer (not shown) can be used to cover the liquid refill hole 114. The sealer (not shown) keeps dust from entering liquid refill hole 114 and the internal part of the lock mechanism 102, thus prolonging the life expectancy of the cartridge 100.

Furthermore, the second air intake hole 154 may be horizontally above the indented slot 152 located on the mounting base 118. This arrangement may be designed to stop and or prevent liquid leakage. When liquid drips to the internal area of the indented slot 152 due to the height difference between the second air intake hole 154 and the indented slot 152, it may take longer for the liquid to accumulate and overflow out of the second air intake hole 154.

Figure 16:
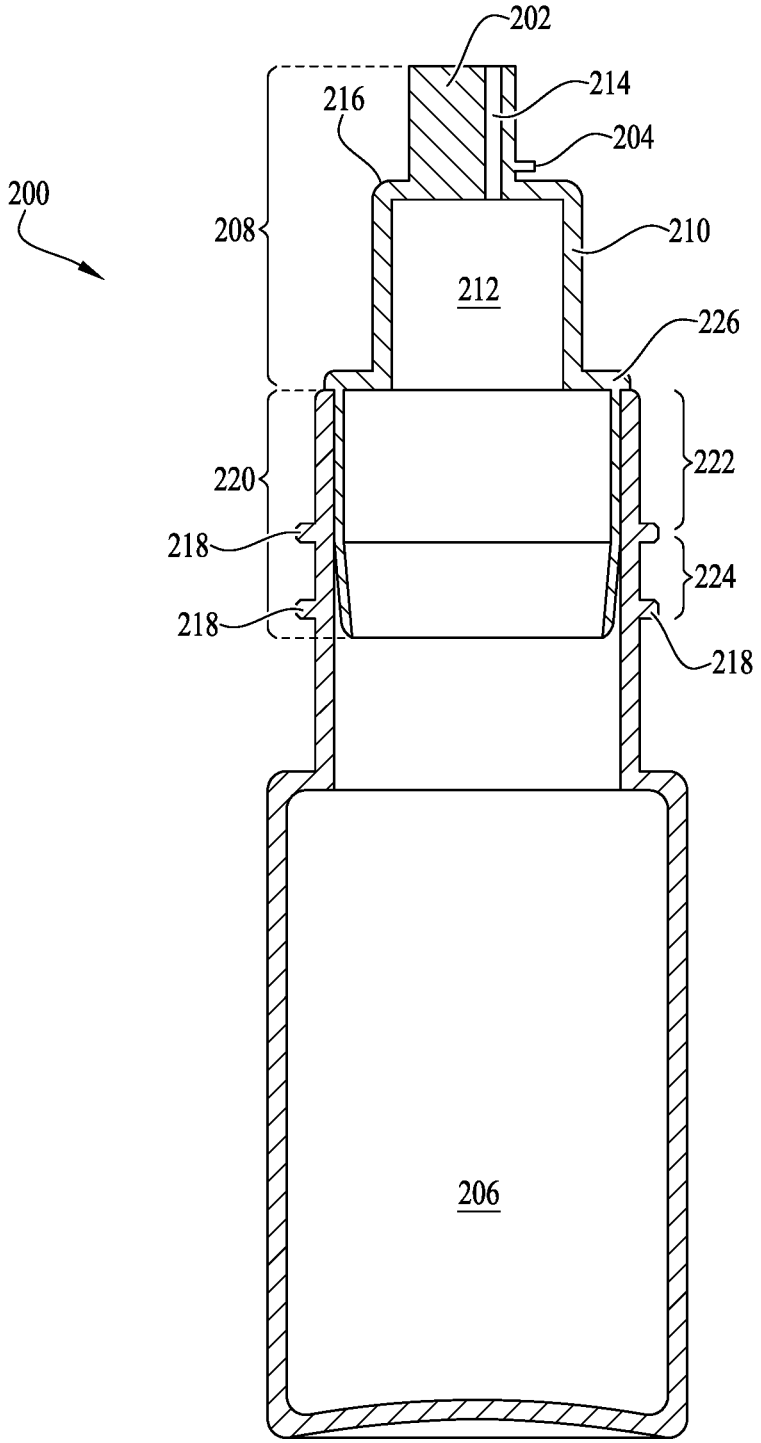
FIG. 16 is a cross-sectional perspective view of one non-limiting embodiment of a refill bottle for use with an apparatus (device) for facilitating the creation of vapor from nicotine and non-nicotine liquid medium.

Referring now to FIG. 16, as mentioned the pipette head key 202 of the bottle 200 may be inserted to the lock mechanism 102 of the cartridge 100 and maintained in an inserted configuration with the use of the entrapment protrusion 204. Accordingly, the bottle 200, subsequent to insertion into the lock mechanism 102, may be rotated together with the lock mechanism 102 to create and open configuration of the first liquid inflow hole 116. The bottle 200 is contemplated to be of 2 main parts, a body 206 and the nozzle 208. Accordingly, the nozzle 208 may consist of the previously mentioned pipette head key 202 which may constitute an upper portion of the nozzle 208 and may further have the entrapment protrusion 204 located to one lateral portion therein. Further, a lower portion of the nozzle 208 may include a stopper 210 which may have a stopper reservoir 212 internal to the stopper 210. Pipette head key 202 may have a liquid channel 214 which traverses the internal portion of the pipette head key 202 and is connected to the stopper reservoir 212. The stopper reservoir 212 is generally in fluid communication with the internal portions of the body 206 of the bottle 200, wherein the majority of the e-liquid may be held prior to use for refilling the cartridge 100. Thus, any liquid being held internal to the bottle 200 may exit the bottle 200 by passing from the internal portion of the body 206, into the stopper reservoir 212, and out the liquid channel 214 to exit the bottle 200. The liquid that flows through this liquid channel 214 may be passed on through to the cartridge 100 liquid tank 112 when the proper alignment of the first liquid inflow hole 116 occurs. As noted, this alignment may occur when the pipette head hey 202 is inserted into the lock mechanism 102 and entraps the entrapment protrusion 204 of the pipette head key 202 of the bottle 200 into the lock mechanism 102 of the cartridge 100. Entrapment protrusion 204 may be connected to the pipette head key 202 and inserted into the entrapment notch 128 of the lock mechanism 102, rotation of the lock mechanism 102 may subsequently occur and an open configuration of the first liquid inflow hole 116 may be created by this rotational movement along one axis.

The cartridge may have two primary configurations, open and closed; however, each fractional configuration between open and closed may also result in the passage of liquid from the bottle 200 to the cartridge 100 liquid tank 112 as described above. Any of these primary and fractional configurations may be achieved by turning the lock mechanism 102 to any point along a hemi-circle. After the liquid filling process is done, the lock mechanism 102 may be returned into the initial position before it may be removed from the cartridge 100. It should be further noted that the pipette head key 202 with the entrapment protrusion 204 may occur in a number of differing configurations. The possible number of configurations and combinations are not currently known, and more may develop in the future. Accordingly, it is noted that the lock mechanism 102 may be altered to accommodate these configurations and combinations. By way of example, the entrapment protrusion 204 may be of any shape and size which still achieves the same result of mechanically manipulating the lock mechanism 102, or alteration of the lock mechanism 102.

As shown in FIG. 14, the pipette head key 202 may have, but is not limited to, a polygonal configuration. The pipette head key 202 may also have configurations such as a triangle, trapezoidal, pentagonal, hexagonal, dodecagonal, etc., and the pipette head key 202 configurations can also have a cross shape or any other shape which is conceivable and operableable with the lock mechanism 102. Furthermore, the pipette head key 202 may also be contemplated to have a gear-like configuration, where the gear teeth can also have various configurations. The pipette head key 202 is also contemplated to have a configuration which is a cylinder with two symmetrical geometries attached to an outer wall. Further, each configuration of the pipette head key 202 may have a different pipette head key 202 specific ability. For example, a gear-like configuration as in FIG. 5 will have better-gripping strength, thus has more durability compared to the house-like configuration in FIG. 3. This will make the configuration in FIG. 3 will be more vulnerable to wear, but easier to manufacture rather than FIG. 5 configuration.

The nozzle 208, as noted, may also have a lower portion referred to as a stopper 210. The stopper 210 may have a larger diameter than the pipette head key 202 which is located to the upper portion of the nozzle 208. The nozzle 208 may be configured in such a way that the length and the depth of the pipette head key 202 and the lock mechanism 102 may be slightly different, with the pipette head key 202 being slightly shorter than the vertical space of the lock mechanism 102. Thus, when the pipette head key 202 of the bottle 200 is inserted into the lock mechanism 102 of the cartridge 100, the upper ledge 216 of the stopper 210 will contact the exterior portion of the mounting base 108 of the cartridge 100, and thus prevent the pipette head key 202 from going further in. This way, the pipette head key 202 may avoid contacting the lock mechanism 102 ceiling 120, causing it to become damaged.

The outer wall of the body 206 of the bottle 200 may include a locking ring 218. This locking ring 218 may be used to lock a cover (not shown) that is available to seal the bottle 200. The locking ring 218 may further be that of threading which may thread a cover (not shown) onto the top of the bottle 200. The locking ring 218 may further snap-fit with a cover (not shown) onto the top of the bottle 200. This feature may prevent any dust or other contaminants from entering the bottle 200. This feature may also maintain the internal humidity percentage of the liquid of the internal portion of the bottle 200. The locking ring 218 may be in plurality.

The connection of the nozzle 208 to the body 206 may be done through an insertion plug 220. The insertion plug 220 may be contiguous with the nozzle 208 but may not be visible when installed into the body 206. The insertion plug 220 may be generally circumferential in shape and hollow in the internal area. However, the insertion plug may take a variety of shapes, by way of example, a rhombus, a quadrilateral, a triangle, or a variety of other shapes and designs. The insertion plug 220 may further be divided into two parts, a flat portion 222 and a tapered portion 224. The flat portion 222 may have a larger width than the tapered portion 224. The tapered portion 224 may generally be tapered to allow for easy insertion of the insertion plug 220 into the body 206 to form the bottle. The insertion plug 220 may not prevent any liquid held internal to the boy 206 from flowing to the stopper reservoir 212 and further to the liquid channel 214 and finally to the liquid tank 112 of the cartridge 100.

Furthermore, there may be a plug ring 226 which is positioned to the top of the body 206 but below that of the nozzle 208 which may function to prevent liquid from leaking due to any gaps around the upper portion of the body 206. The plug ring 226 may further prevent contaminants from entering into the body 206. This feature, like the cover (not shown), can also maintain the humidity of the liquid held internal to the body 206 of the bottle 200.

Having disclosed the structure of the various embodiments, it is now possible to describe its function, operation, and use. There may be a liquid filling hole 114 on one end of the mounting base 108 as mentioned above. There may be a first stage liquid inflow hole 116 on the bottom of the atomization chamber 104. The liquid filling hole 114 on the mounting base 108 and the first liquid inflow hole 116 may be lined correspondingly to form a cavity 118. The cavity 118 may be accommodated with a rotatable lock mechanism 102 that is enclosed with a ceiling 102 on the one end which may also be located to the inner side of the lock mechanism 102. It may have a liquid inflow passageway 122. The liquid inflow passageway 122 may traverse through the ceiling to form a second liquid inflow hole 124.

The bottom of the liquid filling hole 114 may comprise the entrapment ledge 126, and the bottom of the lock mechanism 102 may hold the entrapment notch 128. The entrapment ledge 126 and entrapment notch 128 work cooperatively to allow multi-shaped keys operating the locking mechanism for liquid filling purposes.

On the exterior portion of the locking mechanism 102, there may be a first rotation limitation marker 130, the top of the liquid refilling hole may have a first indented cut out 132, and the first rotation limitation marker 130 may be free to rotate within the first indented cut out 132. The first indented cut out 132 may have a first positioning point 134 and a second positioning point 136. The top of the liquid filling hole 114 may have a multitude of position limitation poles 138, these poles 138 may lay within the first indented cut out 132. The position limitation poles 138 and the first positioning point 134 may form the first jamming slot 140. The position limitation poles 138 and the second positioning point 136 may form the second jamming slot 142.

On the outer wall of the lock mechanism 102, there may be a second rotation limitation marker 144. Further, there may be a second indented cut out 146 on the bottom of the atomization chamber 104. The second rotation limitation marker 144 may be slotted into the second indented cut out 146.

The interior portion of the casing 106 may be lined with a plurality of guided rails 148, and the bottom of the atomization chamber 104 may slide within the rails. There may be a first air intake hole 150 positioned at the center of the bottom of the atomization chamber 150. There may be an indent slot 152 located at the center of the mounting base 108. Further, a second air intake hole may be positioned within the indent slot 152 with the first air intake hole 150 and the second air intake hole 154 being inter-adjustable, inter-changeable, mutually compatible, and/or independently adjustable. The bottom of the first air intake hole 150 may be lower than the top of the second air intake hole 154. In some embodiments, the first indented cut out 132 may have a dedicated opening. Additionally in some embodiments, the lower portion of the lock mechanism 102 may be above the lower portion of the liquid filling hole 114. The second air intake hole may also be horizontally above the indent slot 152 of the mounting base 108. Specifically, a unique feature of the design of this disclosure is that the lower portion of the atomization chamber 102 and the interior portion of the casing 106 may form part of the liquid tank 112.

This disclosure of the multi-shape key system for the lock mechanism of a cartridge 100 may provide particular benefits. With the lock mechanism 102 and the liquid inflow passageway 122 arrangement, a wide assortment of shapes of the pipette head key 202 can work together with the on the liquid bottle 200 to create a multi-shape key system as disclosed herein and illustrated in FIGS. 2, 3, 14 and 15. As the refill bottle 200 is rotated subsequent to insertion into the lock mechanism 102, the lock mechanism 102 is likewise rotated to an open configuration and the liquid inflow passageway 122 may be successfully aligned with the liquid filling hole 114, the second liquid infill hole 124, and the first liquid infill hole 116. Accordingly, as the liquid is passed from the refill bottle 200 to the liquid filling hole 114, the liquid inflow passageway 122 may direct the liquid to the second liquid infill hole 124 and then into the first liquid infill hole 116, and finally into the liquid tank 112 thereby completing the liquid refilling process. As the refilling bottle 200 is rotated in a reverse fashion than previously described, the lock mechanism 102 may be returned to a closed configuration. The ceiling 120 of the lock mechanism 102 may be positioned such that the first liquid infill hole 116 may be covered and securely seal the liquid tank 112 and thereby ensuring that the liquid does not leak from the liquid tank 112.

Further benefits may include but are not limited to the entrapment ledge 126 and the entrapment notch 128 working cooperatively with any of the aforementioned and uniquely shaped pipette head keys 202 of the refill bottle 200 to achieve an interlocking mechanism. Specifically, as the refill bottle 200 is inserted through the liquid filling hole 114 and into the internal structure of the lock mechanism 102, the uniquely shaped pipette head key may become interlocked with both the entrapment ledge 126 and the entrapment notch 128. Rotational movement of the refill bottle 200 with respect to the cartridge 100, results in rotation of the lock mechanism 102, allowing the refill bottle 200 to be held securely by the entrapment notch 128. Hence there is no need to constantly hold the refill bottle 200 to prevent the refill bottle 200 from falling out. This results in a refilling process which is more convenient and easier for the end consumer.

While adjusting to the first jamming slot 140 and the second jamming slot 142, if the first rotation limitation marker 130 of the lock mechanism may be positioned inside the first jamming slot 140 and the second jamming slot 142, more effort is thereby needed to rotate the lock mechanism 102 which may ensure that the open and closed configurations of the lock mechanism 102 are more stable, retainable, and durable. This may prevent the first rotation limitation marker 130 and the first positioning point 134 from coming into contact with the second positioning point 136. External forces causing the aforementioned contact could cause lock mechanism 102 to rotate freely, which is may be very inconvenient for refilling the liquid tank 112 and even result in leakage while the lock is in a closed configuration.

The fluid delivery kit and system having a refill bottle 200 with a pipette head key 202 which may be to one lateral end, a lock mechanism 102 which may be enveloped in a mounting base 108. The mounting base 108 may be reversibly attached to one end of an electronic cigarette cartridge (not shown). The pipette head key 202 may be configured to rotatably engage with the lock mechanism 102 such that a liquid filling hole 114 is configurable to an open position and a closed position. The open position permitting fluid delivery into a liquid tank, said closed position, said closed position preventing fluid escape from the liquid tank. The mounting base may be further configured to have a first liquid inflow hole 116 and the lock mechanism 102 may also further be configured to have a ceiling 120, second liquid inflow hole 124, and an entrapment notch 128.

Figure 18:
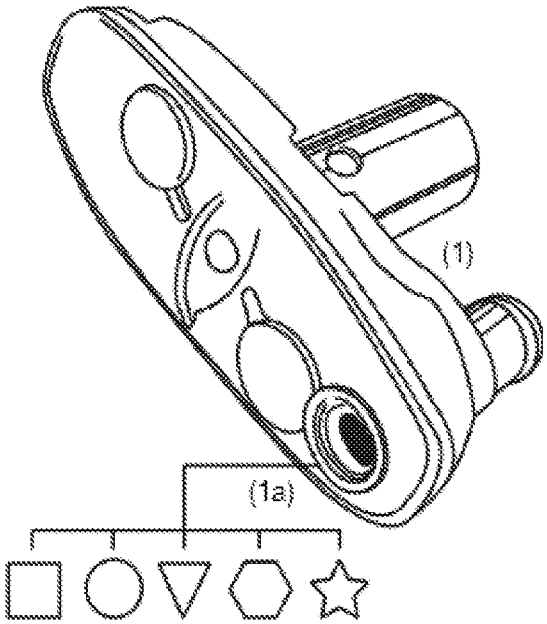
FIG. 18 is a perspective view of non-limiting embodiments illustrating some possible pipette head key shapes for use with an apparatus (device) for facilitating the creation of vapor from nicotine and non-nicotine liquid medium.
Figure 19:
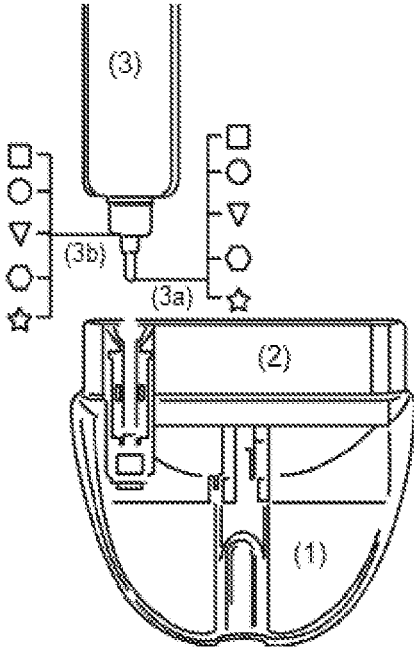
FIG. 19 is a cross sectional view of non-limiting embodiments illustrating some possible pipette head key shapes for use with an apparatus (device) for facilitating the creation of vapor from nicotine and non-nicotine liquid medium; and, FIG. 20 is a top down plan view of various non-limiting embodiments illustrating possible pipette head key shapes for use with an apparatus (device) for facilitating the creation of vapor from nicotine and non-nicotine liquid medium.

The pipette head key 202 shape may be further configured to match the shape of the liquid filling hole as is seen in FIGS. 18 and 19. Additionally, the pipette head key 202 further may have an entrapment protrusion 204, the entrapment protrusion 204 may be configured to engage with the entrapment notch 128. The rotational engagement of the pipette head key 202 with the lock mechanism 102 may result in the alignment of the first liquid inflow hole 116 with the second liquid infill hole 124 and may result an unobstructed liquid inflow passageway 122. The rotational engagement of the pipette head key 202 with the lock mechanism 102 may also result in the misalignment of the first liquid inflow hole 116 with the second liquid infill hole 124 and may result an obstructed liquid inflow passageway 122. The rotational engagement of the pipette head key 202 with the lock mechanism 102 may further result in the entrapment protrusion 204 being entrapped between a entrapment ledge 126 and an entrapment notch 128 simultaneously when the alignment of the first liquid inflow hole 116 with the second liquid infill hole 124 occurs, thereby prohibiting removal of the pipette head key 202 from the lock mechanism 102. Conversely, the rotational engagement of the pipette head key 202 with the lock mechanism 102 may also result the entrapment protrusion 204 being unentrapped between a entrapment ledge 126 and an entrapment notch 128 simultaneously when the misalignment of the first liquid inflow hole 116 with the second liquid infill hole 124 occurs, thereby allowing removal of the pipette head key 202 from the lock mechanism 102+.

Moreover, the atomization chamber 104 may be enclosed within the casing 106 and the casing 106 may further have a vapor opening 110 located to one end of it, the atomization chamber 104 and an inner wall of the casing 106 forming the liquid tank 112. Additionally, the mounting base 108 may be configured to clip onto the casing 106. The locking mechanism 102 may further comprise an outer wall 131, the outer wall 131 may have a first rotation limitation marker. The mounting base 102 may also further have an opening 156, the opening 156 may have a first indented cut out 132, the first indented cut out 132 may have a first positing point 134, a second positioning point 136, and one or more than one position limitation poles 138. The first rotation limitation marker 130 may engage with the first indented cut out 132 and the first limitation marker 130 of the lock mechanism 102 may remain freely rotatable between a first positioning point 134 and the second positioning point 136 of the first indented cut out 132 with the one or more than one position limitation poles 138 providing tactile feedback to a user rotating the bottle 200 in the lock mechanism 102.

Disclosed herein may be a fluid refilling method which may have a pipette head key 204 on one end of a refill bottle 200 and a lock mechanism 102 which may be located to one end of a mounting base 108 of an electronic cigarette cartridge (not shown). The mounting base 108 may have a first liquid inflow hole 116 and the lock mechanism 102 may have a ceiling 120, a second liquid inflow hole 124, and an entrapment notch 128. As seen in FIG. 2, the pipette head key 202 may be inserted into the entrapment notch 128 of the lock mechanism 102 and the lock mechanism 102 may then be rotated in a first direction about one axis. The rotation of the lock mechanism 102 may align the first liquid inflow hole 116 with the second liquid infill hole 124 which may result in an open configuration. This open configuration may permit fluid delivery into a liquid tank 112 through the liquid inflow passageway 122. Accordingly, the lock mechanism 102 may then be rotated in a second direction about one axis, the second direction being in a reverse direction from the first rotation, the second rotation may result in alignment of the ceiling 120 with the first liquid inflow hole 116 and further resulting in a closed configuration, said closed configuration preventing fluid escape from the liquid tank 112.

Further embodiments include a fluid delivery kit for the refilling of electronic cigarette (not shown) cartridges 100 which may include a pipette head key 202 and a lock mechanism 102, wherein the pipette head key 102 may be disposed to one end of a liquid refill bottle 200, the pipette head key 202 may be further configured to rotatably engage (shown in FIG. 2) with the lock mechanism 102 located on a mounting base 108. The mounting base 108 may retain the lock mechanism 102, the lock mechanism 102 may further be freely rotatable and disposed internal to the mounting base 108. The rotatable engagement of the lock mechanism 102 by the pipette head key 202 may be configured to result in an open position of a liquid filling hole 114, wherein the open position may permit fluid delivery into the liquid tank 112. Further, the liquid filling hole 114 may also be configurable to a closed position wherein the closed position may prevent fluid escape from the liquid tank 112. The mounting base 108 may further be configured to have a first liquid inflow hole 116. The lock mechanism 102 may further be configured to have a ceiling 120, a liquid filling hole 114, second liquid inflow hole 124, and an entrapment notch 128. The pipette head key shape 202 may configured to match the shape of the liquid filling hole as seen in FIGS. 14, 18, and 19.

Match being defined herein as the use of the predetermined shape being insertably engageable with the lock mechanism 102, such that the two dimensional planer aspect of the shape, when viewed from a vantage which is directly above or below the shape, may be inserted along the three-dimensional axis when viewed from a lateral perspective. The two dimensional planer slice may approximately match into the lock mechanism 102 via the outline of the two dimensional planer slice as seen in FIG. 14, and may approximately match the depth of the three-dimensional axis when inserted into the lock mechanism 102. Accordingly, if the shape is plotted using a standard three dimensional x, y, z, coordinate grid, along two of the coordinates the shape will approximately match the outline of the lock mechanism 102 (illustrated in FIGS. 18 and 19), then the third coordinate will approximately match the depth of the lock mechanism.

The pipette head key 202 may further have an entrapment protrusion 204, the entrapment protrusion 204 may be configured to engage with the entrapment notch 128 via rotational engagement of the pipette head key 202. The lock mechanism 102 may then result in the alignment of the first liquid inflow hole 116 with the second liquid infill hole 124 and may additionally result an unobstructed liquid inflow passageway 122. Moreover, the rotational engagement of the pipette head key 202 with the lock mechanism 102 may result in the misalignment of the first liquid inflow hole 116 with the second liquid infill hole 124 resulting an obstructed liquid inflow passageway 122.

Further, the rotational engagement of the pipette head key 202 with the lock mechanism 102 may result in the entrapment protrusion 204 being entrapped between an entrapment ledge 126 and an entrapment notch 128 which may occur simultaneous with the alignment of the first liquid inflow hole 116 with the second liquid infill hole 124 which may prohibit removal of the pipette head key 202 from the lock mechanism 102. Moreover, the reverse rotational engagement of the pipette head key 202 with the lock mechanism 102 may result in the entrapment protrusion 204 being unentrapped between a entrapment ledge 126 and an entrapment notch 128 which may occur simultaneous with the misalignment of the first liquid inflow hole 116 with the second liquid infill hole 124 allowing removal of the pipette head key 202 from the lock mechanism 102.

Structurally, the lock mechanism 102 may further comprise an a outer wall 131 having a first rotation limitation marker 130. The mounting base 108 may further having an opening 156, the opening 156 may further have a first indented cut out 132, the first indented cut out 132 may further have a first positing point 134, a second positioning point 136, and one or more than one a limitation pole 138. That first rotation limitation marker 130 may engage with the first indented cut out 132 and the first limitation marker 130 of the lock mechanism 102 may be freely rotatable between a first positing point 134 and second positioning point 136 of the first indented cut out 132 and the one or more than one limitation poles 138. This may provide tactile feedback to a user rotating the bottle 200 in the lock mechanism 102.

Moreover, the inner wall 107 of the casing 106 may be lined with guide rails 148 which may be configured to guide the atomization chamber 104 to proper positioning internal to the casing 106. One end of the atomization chamber 104 may further have a first air intake hole 150 with a further indented slot 152 located correspondingly to a second air intake hole 154 located to the mounting base 108. The second air intake hole 154 may be being positioned within the indented slot 152, such that the first 150 and second air intake holes 154 are inter-adjustable and/or independently adjustable.

| Summary of figure reference numbers for convenient reference: | |
|---|---|
| 100 | Cartridge |
| 102 | Lock Mechanism |
| 104 | Atomization Chamber |
| 106 | Casing |
| 107 | Inner Wall |
| 108 | Mounting Base |
| 110 | Vapor Opening |
| 112 | Liquid Tank |
| 114 | Liquid Filling Hole |
| 116 | First Liquid Inflow Hole |
| 118 | Cavity |
| 120 | Ceiling |
| 122 | Liquid Inflow Passageway |
| 124 | Second Liquid Inflow Hole |
| 126 | Entrapment Ledge |
| 128 | Entrapment Notch |
| 130 | First Rotation Limitation Marker |
| 131 | Outer Wall |
| 132 | First Indented Cut Out |
| 134 | First Positioning Point |
| 136 | Second Positioning Point |
| 138 | Position Limitation Pole |
| 140 | First Jamming Slot |
| 142 | Second Jamming Slot |
| 144 | Second Rotation Limitation Marker |
| 146 | Second Indented Cut Out |
| 148 | Guided Rail |
| 150 | First Air Intake Hole |
| 152 | Indent Slot |
| 154 | Second Air Intake Hole |
| 156 | Opening |
| 200 | Refill Bottle |
| 202 | Pipette Head Key |
| 204 | Entrapment Protrusion |
| 208 | Nozzle |
| 210 | Stopper |
| 212 | Stopper Reservoir |
| 214 | Liquid Channel |
| 216 | Upper Ledge |
| 218 | Locking Ring |
| 220 | Insertion Plug |
| 222 | Flat Portion |
| 224 | Tapered Portion |
| 226 | Plug Ring |

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

Accordingly, it is not intended that the invention be limited except by the appended claims. Insofar as the description above and the accompanying drawings disclose any additional subject matter that is not within the scope of the claims below, the inventions are not dedicated to the public and the right to file one or more applications to claim such additional inventions is reserved.

Furthermore, this disclosure relates to the implementation of an electronic cigarette (not shown), which uses the lock mechanism 102, the implemented prototype described above is drawn as a reference for the actual structural design of an electronic cigarette (not shown) cartridge 100. Since the electronic cigarette (not shown) is derived from all of the technical practices as described above, rights are reserved for all the benefits gained from any and all of the points stated above, for the development of a multi-shape key system for the lock mechanism of a cartridge 100.

The contents above described the prioritized implementation example for this invention, it is not used to set the limitation for the rightful claim of this invention. Any ideas that build on the scope of this invention, the use of this invention claims, drawings, in which leads to any structural design with the same functionalities, or directly and indirectly applied in other related technical fields, are all considered to fall under the rightful claim and protection of this invention.

What is claimed is:

1. A fluid delivery kit, comprising:

a refill bottle with a pipette head key to one lateral end, a lock mechanism enveloped in a mounting base, the mounting base reversibly attached to one end of a cartridge;

wherein the pipette head key is configured to rotatably engage with the lock mechanism such that a liquid filling hole is configurable to an open position and a closed position, said open position permitting fluid delivery into a liquid tank, said closed position preventing fluid escape from the liquid tank;

wherein the mounting base is further configured to have a first liquid inflow hole and the lock mechanism further configured to have a ceiling, a second liquid inflow hole, and an entrapment notch;

the pipette head key is configured to have a protruding shape, the liquid filling hole is configured to have an intruding shape, wherein the shapes are configured to match such that the protruding shape of the pipette head key is insertable to the intruding shape of the liquid filling hole;

the pipette head key further has an entrapment protrusion, the entrapment protrusion configured to engage with the entrapment notch;

a first rotational engagement of the pipette head key with the lock mechanism results in the alignment of the first liquid inflow hole with a second liquid infill hole resulting in a liquid inflow passageway which is unobstructed;

a second rotational engagement of the pipette head key with the lock mechanism results in the misalignment of the first liquid inflow hole with the second liquid infill hole resulting in the liquid inflow passageway being obstructed; and, the first rotational engagement of the pipette head key with the lock mechanism results in the entrapment protrusion being entrapped between an entrapment ledge and the entrapment notch simultaneous with the alignment of the first liquid inflow hole with the second liquid infill hole prohibiting removal of the pipette head key from the lock mechanism.

2. The fluid delivery kit of claim 1, wherein the second rotational engagement of the pipette head key with the lock mechanism results the entrapment protrusion being unentrapped between the entrapment ledge and the entrapment notch simultaneous with the misalignment of the first liquid inflow hole with the second liquid infill hole allowing removal of the pipette head key from the lock mechanism.

3. The fluid delivery kit of claim 1, wherein an atomization chamber is enclosed within a casing, the casing further having a vapor opening located to one end of the casing, the atomization chamber and an inner wall of the casing forming the liquid tank.

4. The fluid delivery kit of claim 1, wherein the mounting base is configured to reversibly attach to the casing.

5. The fluid delivery kit of claim 1 wherein the locking mechanism further comprises an outer wall, the outer wall having a first rotation limitation marker;

the mounting base further having an opening, the opening having a first indented cut out, the first indented cut out having a first positioning point, a second positioning point, and one or more than one a position limitation pole; and, the first rotation limitation marker engaging with the first indented cut out, the first limitation marker of the lock mechanism being freely to rotatable between the first positioning point and the second positioning point of the first indented cut out and one or more than one the position limitation pole providing tactile feedback to a user rotating the bottle in the lock mechanism.

6. The fluid delivery kit of claim 1 wherein the inner wall of the casing is lined with one or more than one a guide rail configured to align the atomization chamber for proper positioning internal to the casing.

7. The fluid delivery kit of claim 1 wherein one end of the atomization chamber has a first air intake hole and the mounting base has an indented slot located correspondingly with a second air intake hole, the second air intake hole being positioned within the indented slot, such that the first air intake hole and the second air intake hole are independently adjustable.

8. A fluid delivery kit for refilling electronic cigarette cartridges, comprising:

a pipette head key and a lock mechanism, wherein the pipette head key is disposed to one end of a refill bottle, the pipette head key being configured to rotatably engage with the lock mechanism located on a mounting base, the mounting base retaining the lock mechanism, the lock mechanism being freely rotatable internal to the mounting base;

wherein the rotatable engagement of the lock mechanism by the pipette head key is configured to result in an open position of a liquid filling hole, said open position permitting fluid delivery into a liquid tank, the liquid filling hole further configurable to a closed position, said closed position preventing fluid escape from the liquid tank;

wherein the lock mechanism is further configured to have a second liquid inflow hole and an entrapment notch;

wherein the pipette head key is configured to have a protruding shape, the liquid filling hole is configured to have an intruding shape, wherein the shapes are configured to match such that protruding shape of the pipette head key is insertable in the intruding shape of the liquid filling hole;

wherein the pipette head key further has an entrapment protrusion, the entrapment protrusion configured to engage with the entrapment notch;

wherein the rotational engagement of the pipette head key with the lock mechanism results in the alignment of the first liquid inflow hole with a second liquid infill hole resulting in a liquid inflow passageway which is unobstructed wherein the rotational engagement of the pipette head key with the lock mechanism results in the misalignment of the first liquid inflow hole with the second liquid infill hole resulting the liquid inflow passageway being obstructed; and, wherein the rotational engagement of the pipette head key with the lock mechanism results the entrapment protrusion being entrapped between an entrapment ledge and the entrapment notch simultaneous with the alignment of the first liquid inflow hole with the second liquid infill hole prohibiting removal of the pipette head key from the lock mechanism.

9. The fluid delivery kit for refilling electronic cigarette cartridges of claim 8, wherein the rotational engagement of the pipette head key with the lock mechanism results the entrapment protrusion being unentrapped between the entrapment ledge and the entrapment notch simultaneous with the misalignment of the first liquid inflow hole with the second liquid infill hole allowing removal of the pipette head key from the lock mechanism.

10. The fluid delivery kit for refilling electronic cigarette cartridges of claim 8, wherein an atomization chamber is enclosed within a casing, the casing further having a vapor opening located to one end of the casing, the atomization chamber and an inner wall of the casing forming the liquid tank.

11. The fluid delivery kit for refilling electronic cigarette cartridges of claim 8, wherein the mounting base being configured to reversibly attach to the casing.

12. The fluid delivery kit for refilling electronic cigarette cartridges of claim 8 wherein the locking mechanism further comprises an outer wall, the outer wall having a first rotation limitation marker;

the mounting base further having an opening, the opening having a first indented cut out, the first indented cut out having a first positioning point, a second positioning point, and one or more than one a position limitation pole; and, the first rotation limitation marker engaging with the first indented cut out, the first limitation marker of the lock mechanism being freely to rotatable between the first positioning point and the second positioning point of the first indented cut out and one or more than one the limitation pole providing tactile feedback to a user rotating the bottle in the lock mechanism.

13. The fluid delivery kit for refilling electronic cigarette cartridges of claim 8 wherein the inner wall of the casing is lined with one or more than one a guide rail configured to align the atomization chamber to proper positioning internal to the casing.

14. The fluid delivery kit for refilling electronic cigarette cartridges of claim 8 wherein one end of the atomization chamber has a first air intake hole and the mounting base has an indented slot located correspondingly to a second air intake hole, the second air intake hole being positioned within the indented slot, such that the first air intake hole and the second air intake hole are independently adjustable.

15. An electronic cigarette refill system, comprising:

a mounting base, a lock mechanism, an atomization chamber, and a casing;

wherein the mounting base has an opening, the lock mechanism being placed internal to the opening and the atomization chamber and mounting based positioned on either end of the lock mechanism enclosing the lock mechanism, the lock mechanism maintaining free rotational movement while in an enclosed configuration;

the mounting base, the atomization chamber, and the lock mechanism being placed internal to the casing, wherein the casing forms a first portion of a liquid tank and the atomization chamber forms a second portion of the liquid tank, thereby defining the entire tank;

the mounting base having a first liquid inflow hole, the lock mechanism having a ceiling and a second liquid inflow hole positioned nearer the liquid tank, the lock mechanism further having and a liquid filling hole configured to insertably accept a pipette head key, upon insertion of the pipette head key into the lock mechanism, the lock mechanism and the pipette head key being rotatable about one axis, the ceiling of the lock mechanism rotating and resulting in the alignment of the first liquid inflow hole and the second liquid inflow hole to form a liquid inflow passage;

said alignment corresponding to a transition from a closed configuration to an open configuration, the liquid inflow passage corresponding to free liquid movement from a refill bottle to the internal portion of the liquid tank; and, wherein the rotational engagement of the pipette head key with the lock mechanism results an entrapment protrusion being entrapped between an entrapment ledge and an entrapment notch simultaneous with the alignment of the first liquid inflow hole with a second liquid infill hole prohibiting removal of the pipette head key from the lock mechanism.

16. The electronic cigarette refill system of claim 15, wherein the rotational engagement of the pipette head key with the lock mechanism results the entrapment protrusion being unentrapped between the entrapment ledge and the entrapment notch simultaneous with the misalignment of the first liquid inflow hole with the second liquid infill hole allowing removal of the pipette head key from the lock mechanism.

17. The fluid delivery kit of claim 15, wherein the mounting base being configured to reversibly attach to the casing.

18. The fluid delivery kit of claim 15 wherein the locking mechanism further comprises an outer wall, the outer wall having a first rotation limitation marker;

the mounting base further having an opening, the opening having a first indented cut out, the first indented cut out having a first positioning point, a second positioning point, and one or more than one a position limitation pole; and, the first rotation limitation marker engaging with the first indented cut out, the first limitation marker of the lock mechanism being freely to rotatable between the first positioning point and the second positioning point of the first indented cut out and one or more than one the limitation pole providing tactile feedback to a user rotating the bottle in the lock mechanism.

19. The fluid delivery kit of claim 15 wherein an inner wall of the casing is lined with one or more than one a guide rail configured to align the atomization chamber to proper positioning internal to the casing.

20. The fluid delivery kit of claim 15 wherein one end of the atomization chamber has a first air intake hole and the mounting base has an indented slot located correspondingly to a second air intake hole, the second air intake hole being positioned within the indented slot, such that the first air intake hole and the second air intake hole are independently adjustable.

* * * * *